US009027675B1

(12) United States Patent
Jones et al.

(10) Patent No.: US 9,027,675 B1
(45) Date of Patent: May 12, 2015

(54) POLYCRYSTALLINE DIAMOND COMPACT INCLUDING A POLYCRYSTALLINE DIAMOND TABLE CONTAINING ALUMINUM CARBIDE THEREIN AND APPLICATIONS THEREFOR

(75) Inventors: Paul Douglas Jones, Elk Ridge, UT (US); Kenneth E. Bertagnolli, Riverton, UT (US); Debkumar Mukhopadhyay, Sandy, UT (US); David P. Miess, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 638 days.

(21) Appl. No.: 13/100,388

(22) Filed: May 4, 2011

Related U.S. Application Data

(63) Continuation-in-part of application No. 13/027,954, filed on Feb. 15, 2011.

(51) Int. Cl.
*E21B 10/46* (2006.01)
*E21B 10/56* (2006.01)

(52) U.S. Cl.
CPC ..... *E21B 10/46* (2013.01); *E21B 10/56* (2013.01)

(58) Field of Classification Search
CPC ..... E21B 10/46; E21B 10/56
USPC ..... 175/425, 434
See application file for complete search history.

(56) References Cited

U.S. PATENT DOCUMENTS

| | | | |
|---|---|---|---|
| 2,349,577 | A | 5/1944 | Dean |
| 3,745,623 | A | 7/1973 | Wentorf, Jr. et al. |
| 3,918,219 | A | 11/1975 | Wentorf, Jr. et al. |
| 4,009,027 | A | 2/1977 | Naidich et al. |
| 4,016,736 | A | 4/1977 | Carrison et al. |
| 4,063,909 | A | 12/1977 | Mitchell |
| 4,084,942 | A | 4/1978 | Villalobos |
| 4,191,735 | A | 3/1980 | Nelson et al. |
| 4,224,380 | A | 9/1980 | Bovenkerk et al. |
| 4,268,276 | A | 5/1981 | Bovenkerk |
| 4,274,900 | A | 6/1981 | Mueller et al. |
| 4,333,902 | A | 6/1982 | Hara |
| 4,410,054 | A | 10/1983 | Nagel et al. |

(Continued)

FOREIGN PATENT DOCUMENTS

| | | |
|---|---|---|
| EP | 0 297 071 | 12/1988 |
| EP | 0 352 811 | 1/1990 |

(Continued)

OTHER PUBLICATIONS

U.S. Appl. No. 60/850,969, filed Oct. 10, 2006, Cooley, et al.

(Continued)

*Primary Examiner* — Brad Harcourt
(74) *Attorney, Agent, or Firm* — Dorsey & Whitney LLP

(57) ABSTRACT

Embodiments of the invention relate to polycrystalline diamond compacts ("PDCs") comprising a polycrystalline diamond ("PCD") table including at least a portion having aluminum carbide disposed interstitially between bonded-together diamond grains thereof, and methods of fabricating such PDCs. In an embodiment, a PDC includes a substrate, and a PCD table bonded to the substrate. The PCD table includes a plurality of bonded-together diamond grains defining a plurality of interstitial regions. The PCD table further includes aluminum carbide disposed in at least a portion of the plurality of interstitial regions.

39 Claims, 22 Drawing Sheets

(56) References Cited

U.S. PATENT DOCUMENTS

| | | | |
|---|---|---|---|
| 4,440,573 | A | 4/1984 | Ishizuka |
| 4,460,382 | A | 7/1984 | Ohno |
| 4,468,138 | A | 8/1984 | Nagal |
| 4,560,014 | A | 12/1985 | Geczy |
| 4,676,124 | A | 6/1987 | Fischer |
| 4,692,418 | A | 9/1987 | Boecker et al. |
| 4,738,322 | A | 4/1988 | Hall et al. |
| 4,766,027 | A | 8/1988 | Burn et al. |
| 4,778,486 | A | 10/1988 | Csillag et al. |
| 4,797,326 | A | 1/1989 | Csillag |
| 4,811,801 | A | 3/1989 | Salesky et al. |
| 4,913,247 | A | 4/1990 | Jones |
| 4,940,180 | A | 7/1990 | Martell |
| 4,985,051 | A | 1/1991 | Ringwood |
| 4,992,082 | A | 2/1991 | Drawl et al. |
| 5,011,514 | A | 4/1991 | Cho et al. |
| 5,016,718 | A | 5/1991 | Tandberg |
| 5,032,147 | A | 7/1991 | Frushour |
| 5,049,164 | A | 9/1991 | Horton et al. |
| 5,092,687 | A | 3/1992 | Hall |
| 5,120,327 | A | 6/1992 | Dennis |
| 5,127,923 | A | 7/1992 | Bunting et al. |
| 5,135,061 | A | 8/1992 | Newton, Jr. |
| 5,151,107 | A | 9/1992 | Cho et al. |
| 5,154,245 | A | 10/1992 | Waldenstrom et al. |
| 5,173,091 | A | 12/1992 | Marek |
| 5,180,022 | A | 1/1993 | Brady |
| 5,217,154 | A | 6/1993 | Elwood et al. |
| 5,326,380 | A | 7/1994 | Yao et al. |
| 5,348,109 | A | 9/1994 | Griffin |
| 5,355,969 | A | 10/1994 | Hardy et al. |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 5,617,997 | A | 4/1997 | Kobayashi et al. |
| 5,645,617 | A | 7/1997 | Frushour |
| 5,660,075 | A | 8/1997 | Johnson et al. |
| 5,876,859 | A | 3/1999 | Saxelby, Jr. et al. |
| 5,976,707 | A | 11/1999 | Grab |
| 6,054,693 | A | 4/2000 | Barmatz et al. |
| 6,165,616 | A | 12/2000 | Lemelson et al. |
| 6,209,429 | B1 | 4/2001 | Urso, III et al. |
| 6,220,375 | B1 | 4/2001 | Butcher et al. |
| 6,302,225 | B1 | 10/2001 | Yoshida et al. |
| 6,338,754 | B1 | 1/2002 | Cannon et al. |
| 6,344,149 | B1 | 2/2002 | Oles |
| 6,390,181 | B1 | 5/2002 | Hall et al. |
| 6,410,085 | B1 | 6/2002 | Griffin et al. |
| 6,435,058 | B1 | 8/2002 | Matthias et al. |
| 6,481,511 | B2 | 11/2002 | Matthias et al. |
| 6,544,308 | B2 | 4/2003 | Griffin et al. |
| 6,562,462 | B2 | 5/2003 | Griffin et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,739,214 | B2 | 5/2004 | Griffin et al. |
| 6,749,033 | B2 | 6/2004 | Griffin et al. |
| 6,793,681 | B1 | 9/2004 | Pope et al. |
| 6,797,236 | B2 | 9/2004 | Stoschek |
| 6,797,326 | B2 | 9/2004 | Griffin et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,892,836 | B1 | 5/2005 | Eyre et al. |
| 7,060,641 | B2 | 6/2006 | Qian et al. |
| 7,377,341 | B2 | 5/2008 | Middlemiss et al. |
| 7,384,821 | B2 | 6/2008 | Sung |
| 7,473,287 | B2 | 1/2009 | Belnap et al. |
| 7,516,804 | B2 | 4/2009 | Vail |
| 7,552,782 | B1 | 6/2009 | Sexton et al. |
| 7,559,695 | B2 | 7/2009 | Sexton et al. |
| 7,569,176 | B2 | 8/2009 | Pope et al. |
| 7,608,333 | B2 | 10/2009 | Eyre et al. |
| 7,635,035 | B1 | 12/2009 | Bertagnolli et al. |
| 7,647,993 | B2 | 1/2010 | Middlemiss |
| 7,694,757 | B2 | 4/2010 | Keshavan et al. |
| 7,740,673 | B2 | 6/2010 | Eyre et al. |
| 7,754,333 | B2 | 7/2010 | Eyre et al. |
| 7,841,428 | B2 | 11/2010 | Bertagnolli |
| 7,845,438 | B1 | 12/2010 | Vail et al. |
| 7,866,418 | B2 | 1/2011 | Bertagnolli et al. |
| 7,942,219 | B2 | 5/2011 | Keshavan et al. |
| 8,034,136 | B2 | 10/2011 | Sani |
| 8,066,087 | B2 | 11/2011 | Griffo et al. |
| 8,069,937 | B2 | 12/2011 | Mukhopadhyay et al. |
| 8,071,173 | B1 | 12/2011 | Sani |
| 8,080,074 | B2 | 12/2011 | Sani |
| 8,147,572 | B2 | 4/2012 | Eyre et al. |
| 8,202,335 | B2 | 6/2012 | Cooley et al. |
| 8,297,382 | B2 | 10/2012 | Bertagnolli et al. |
| 8,353,371 | B2 | 1/2013 | Cooley et al. |
| 8,415,033 | B2 | 4/2013 | Matsuzawa |
| 8,616,306 | B2 | 12/2013 | Bertagnolli et al. |
| 2003/0019333 | A1 | 1/2003 | Scott |
| 2004/0111159 | A1 | 6/2004 | Pope et al. |
| 2004/0155096 | A1 | 8/2004 | Zimmerman et al. |
| 2005/0044800 | A1 | 3/2005 | Hall et al. |
| 2005/0050801 | A1 | 3/2005 | Cho et al. |
| 2005/0110187 | A1 | 5/2005 | Pope et al. |
| 2005/0117984 | A1 | 6/2005 | Eason |
| 2005/0210755 | A1 | 9/2005 | Cho et al. |
| 2006/0060392 | A1* | 3/2006 | Eyre ..... 175/434 |
| 2006/0266558 | A1 | 11/2006 | Middlemiss et al. |
| 2007/0056778 | A1 | 3/2007 | Webb et al. |
| 2007/0079994 | A1 | 4/2007 | Middlemiss |
| 2007/0187153 | A1 | 8/2007 | Bertagnolli |
| 2007/0187155 | A1 | 8/2007 | Middlemiss |
| 2008/0185189 | A1 | 8/2008 | Giffo et al. |
| 2008/0206576 | A1* | 8/2008 | Qian et al. ..... 428/446 |
| 2008/0223575 | A1* | 9/2008 | Oldham et al. ..... 166/285 |
| 2008/0223621 | A1 | 9/2008 | Middlemiss et al. |
| 2008/0223623 | A1 | 9/2008 | Keshavan et al. |
| 2008/0230280 | A1 | 9/2008 | Keshavan et al. |
| 2008/0247899 | A1 | 10/2008 | Cho et al. |
| 2009/0090563 | A1 | 4/2009 | Voronin et al. |
| 2009/0120009 | A1 | 5/2009 | Sung |
| 2009/0152015 | A1 | 6/2009 | Sani et al. |
| 2009/0173015 | A1 | 7/2009 | Keshavan et al. |
| 2009/0173547 | A1* | 7/2009 | Voronin et al. ..... 175/375 |
| 2009/0313908 | A1 | 12/2009 | Zhang et al. |
| 2010/0012389 | A1 | 1/2010 | Zhang et al. |
| 2010/0038148 | A1 | 2/2010 | King |
| 2010/0095602 | A1 | 4/2010 | Belnap et al. |
| 2010/0122852 | A1 | 5/2010 | Russell et al. |
| 2010/0155149 | A1 | 6/2010 | Keshavan et al. |
| 2010/0181117 | A1 | 7/2010 | Scott |
| 2010/0236836 | A1 | 9/2010 | Voronin |
| 2010/0243336 | A1 | 9/2010 | Dourfaye et al. |
| 2010/0287845 | A1 | 11/2010 | Montross et al. |
| 2011/0023375 | A1 | 2/2011 | Sani et al. |
| 2011/0031031 | A1 | 2/2011 | Vempati et al. |
| 2011/0067929 | A1 | 3/2011 | Mukhopadhyay et al. |
| 2011/0083908 | A1 | 4/2011 | Shen et al. |
| 2011/0259648 | A1 | 10/2011 | Sani |
| 2011/0284294 | A1 | 11/2011 | Cox et al. |
| 2012/0000136 | A1 | 1/2012 | Sani |
| 2012/0037429 | A1 | 2/2012 | Davies et al. |
| 2012/0047815 | A1 | 3/2012 | Sani |
| 2012/0103701 | A1 | 5/2012 | Cho et al. |
| 2012/0138370 | A1 | 6/2012 | Mukhopadhyay et al. |
| 2013/0205677 | A1 | 8/2013 | Bertagnolli et al. |
| 2013/0291443 | A1 | 11/2013 | Naidoo et al. |
| 2014/0283457 | A1 | 9/2014 | Cariveau et al. |

FOREIGN PATENT DOCUMENTS

| | | |
|---|---|---|
| EP | 0 374 424 | 6/1990 |
| EP | 0 699 642 | 3/1996 |
| GB | 2300424 | 11/1996 |
| GB | 2 461 198 | 12/2009 |
| WO | WO 2008/063568 | 5/2008 |

(56) References Cited

FOREIGN PATENT DOCUMENTS

| | | |
|---|---|---|
| WO | WO 2010/039346 | 4/2010 |
| WO | WO 2010/098978 | 9/2010 |
| WO | WO 2010/100629 | 9/2010 |
| WO | WO 2010/100630 | 9/2010 |

OTHER PUBLICATIONS

U.S. Appl. No. 60/860,098, filed Nov. 20, 2006, Sani.
U.S. Appl. No. 60/876,701, filed Dec. 21, 2006, Sani.
U.S. Appl. No. 13/285,198, filed Oct. 31, 2011, Sani.
U.S. Appl. No. 12/363,104, Oct. 14, 2010, Office Action.
U.S. Appl. No. 12/363,104, Apr. 12, 2011, Office Action.
U.S. Appl. No. 12/363,104, Aug. 25, 2011, Notice of Allowance.
U.S. Appl. No. 13/032,350, Nov. 26, 2012, Restriction Requirement.
U.S. Appl. No. 13/032,350, Mar. 14, 2013, Office Action.
U.S. Appl. No. 13/230,125, May 23, 2012, Restriction Requirement.
U.S. Appl. No. 13/230,125, Jul. 11, 2012, Office Action.
U.S. Appl. No. 13/230,125, Jan. 18, 2013, Office Action.
U.S. Appl. No. 13/285,198, Apr. 3, 2012, Restriction Requirement.
U.S. Appl. No. 13/285,198, Jul. 11, 2012, Office Action.
U.S. Appl. No. 13/285,198, Feb. 5, 2013, Notice of Allowance.
U.S. Appl. No. 13/292,491, Aug. 8, 2012, Restriction Requirement.
U.S. Appl. No. 13/292,491, Feb. 11, 2013, Office Action.
U.S. Appl. No. 11/545,929, filed Oct. 10, 2006, Bertagnolli.
U.S. Appl. No. 12/394,356, filed Feb. 27, 2009, Vail.
U.S. Appl. No. 12/397,969, filed Apr. 9, 2009, Bertagnolli.
U.S. Appl. No. 12/548,584, filed Aug. 27, 2009, Bertagnolli.
U.S. Appl. No. 13/027,954, filed Feb. 15, 2011, Miess et al.
U.S. Appl. No. 61/068,120, filed Mar. 3, 2008, Vail.
Akaishi, Minoru, "Synthesis of polycrystalline diamond compact with magnesium carbonate and its physical properties," Diamond and Related Materials, 1996 (pp. 2-7).
Glowka, D.A. & Stone, C.M., "Effects of Termal and Mechanical Loading on PDC Bit Life", SPE Drilling Engineering, Jun. 1986 (pp. 201-214).
Hsueh, C.H. & Evans, A.G., "Residual Stresses in Metal/Ceramic Bonded Strips", J. Am. Ceram. Soc., 68 [5] (1985) pp. 241-248.
Lin, Tze-Pin; Hood, Michael & Cooper George A., "Residual Stresses in Polycrystalline Diamond Compacts", J. Am. Ceram Soc., 77 [6] (1994) pp. 1562-1568.
Orwa, J.O., et al., "Diamond nanocrystals formed by direct implantation of fused silica with carbon," Journal of Applied Physics, vol. 90, No. 6, 2001, pp. 3007-3018.
Radtke, Robert, "Faster Drilling, Longer Life: Thermally Stable Diamond Drill Bit Cutters," Drilling Systems, Summer 2004 (pp. 5-9).
Suryanarayana, C., "Novel Methods of Brazing Dissimilar Materials," Advanced Materials & Processes, Mar. 2001 (3 pgs).
Timoshenko, S.P. & Goodler, J.N., "Theory of Elasticity", McGraw-Hill Classic Textbook Reissue 1934, pp. 8-11, 456-458.
Tomlinson, P.N. et al. "Syndax3 Pins-New Concepts in PCD Drilling," Rock Drilling, IDR 3/92, 1992 (pp. 109-114).
Ueda, Fumihiro, "Cutting performance of sintered diamond with MgCO3 as a sintering agent," Materials Science and Engineering, 1996 (pp. 260-263).
U.S. Appl. No. 11/545,929, Aug. 13, 2008, Office Action.
U.S. Appl. No. 11/545,929, Jan. 21, 2009, Office Action.
U.S. Appl. No. 11/545,929, Aug. 27, 2009, Office Action.
U.S. Appl. No. 11/545,929, Apr. 15, 2010, Office Action.
U.S. Appl. No. 11/545,929, Jul. 21, 2010, Office Action.
U.S. Appl. No. 13/171,735, Jan. 24, 2013, Final Office Action.
Ledbetter, H.M., et al. "Elastic Properties of Metals and Alloys. II. Copper", Journal of Physics and Chemical Reference Data, vol. 3, No. 4, 1974. pp. 897-935.
U.S. Appl. No. 13/690,397, Feb. 14, 2013, Office Action.
U.S. Appl. No. 13/690,397, filed Nov. 30, 2012, Miess et al.
U.S. Appl. No. 12/548,584, Jan. 3, 2013, Office Action.
U.S. Appl. No. 13/230,125, May 1, 2013, Notice of Allowance.
U.S. Appl. No. 13/292,900, May 23, 2013, Office Action.
U.S. Appl. No. 13/690,397, May 29, 2013, Notice of Allowance.
U.S. Appl. No. 12/961,787, May 29, 2013, Restriction Requirement.
U.S. Appl. No. 13/953,453, filed Jul. 29, 2013, Sani.
U.S. Appl. No. 12/548,584, Jun. 14, 2013, Office Action.
U.S. Appl. No. 13/171,735, Jul. 12, 2013, Office Action.
U.S. Appl. No. 13/285,198, Jul. 22, 2013, Notice of Allowance.
U.S. Appl. No. 13/292,491, Jul. 18, 2013, Office Action.
U.S. Appl. No. 13/027,954, Jul. 18, 2013, Office Action.
U.S. Appl. No. 13/230,125, Aug. 21, 2013, Issue Notification.
U.S. Appl. No. 13/690,397, Aug. 9, 2013, Office Action.
U.S. Appl. No. 13/917,952, Jul. 31, 2013, Office Action.
U.S. Appl. No. 12/961,787, Aug. 30, 2013, Office Action.
U.S. Appl. No. 13/171,735, filed Jun. 29, 2011, Bertagnolli.
U.S. Appl. No. 12/394,356, Sep. 1, 2011, Notice of Allowance.
U.S. Appl. No. 14/067,831, filed Oct. 30, 2013, Bertagnolli et al.
U.S. Appl. No. 12/548,584, Sep. 26, 2013, Office Action.
U.S. Appl. No. 13/032,350, Sep. 30, 2013, Office Action.
U.S. Appl. No. 13/292,491, Oct. 29, 2013, Office Action.
U.S. Appl. No. 13/292,900, Oct. 22, 2013, Notice of Allowance.
U.S. Appl. No. 13/323,138, Oct. 1, 2013, Office Action.
U.S. Appl. No. 13/953,453, Sep. 19, 2013, Office Action.
U.S. Appl. No. 13/953,453, Oct. 10, 2013, Office Action.
U.S. Appl. No. 13/292,900, filed Nov. 9, 2011, Vail.
U.S. Appl. No. 13/323,138, filed Dec. 12, 2011, Miess et al.
Hosomi, Satoru, et al., "Diamond Formation by a Solid State Reaction", Science and Technology of New Diamond, pp. 239-243 (1990).
Liu, Xueran, et al., "Fabrication of the supersaturated solid solution of carbon in copper by mechanical alloying", Materials Characterization, vol. 58, Issue 8 (Jun. 2007), pp. 504-508.
Saji, S., et al., Solid Solubility of Carbon in Copper during Mechanical Alloying, Materials Transactions, vol. 39, No. 7 (1998), pp. 778-781.
Tanaka, T., et al., "Formation of Metastable Phases of Ni—C and Co—C Systems by Mechanical Alloying", Metallurgical Transactions, vol. 23A, Sep. 1992, pp. 2431-2435.
Yamane, T., et al., "Solid solubility of carbon in copper mechanically alloyed", Journal of Materials Science Letters 20 (2001), pp. 259-260.
U.S. Appl. No. 12/394,356, Nov. 30, 2011, Issue Notification.
U.S. Appl. No. 13/285,198, Nov. 22, 2013, Notice of Allowance.
U.S. Appl. No. 13/027,954, Nov. 13, 2013, Office Action.
U.S. Appl. No. 13/690,397, Nov. 25, 2013, Office Action.
U.S. Appl. No. 13/917,952, Nov. 13, 2013, Office Action.
U.S. Appl. No. 13/292,900, Nov. 25, 2013, Notice of Allowance.
U.S. Appl. No. 13/323,138, Nov. 29, 2013, Notice of Allowance.
U.S. Appl. No. 13/397,971, filed Feb. 16, 2012, Miess et al.
U.S. Appl. No. 11/545,929, Mar. 20, 2012, Notice of Allowance.
U.S. Appl. No. 11/545,929, Jul. 18, 2012, Issue Notification.
U.S. Appl. No. 12/397,969, May 25, 2012, Notice of Allowance.
U.S. Appl. No. 12/397,969, Nov. 14, 2012, Issue Notification.
U.S. Appl. No. 12/548,584, May 18, 2012, Office Action.
U.S. Appl. No. 12/548,584, Oct. 24, 2012, Office Action.
U.S. Appl. No. 13/171,735, Aug. 17, 2012, Office Action.
U.S. Appl. No. 14/264,932, filed Apr. 29, 2014, Vail.
U.S. Appl. No. 13/032,350, Apr. 15, 2014, Notice of Allowance.
U.S. Appl. No. 13/171,735, May 7, 2014, Notice of Allowance.
U.S. Appl. No. 14/178,118, filed Feb. 11, 2014, Mukhopadhyay et al.
Decker, et al., "High-Pressure Calibration: A Critical Review," J. Phys. Chem. Ref. Data, 1, 3 (1972).
Rousse, et al. "Structure of the Intermediate Phase of PbTe at High Pressure," Physical Review B: Condensed Matter and Materials Physics, 71, 224116 (2005).
U.S. Appl. No. 12/548,584, Mar. 6, 2014, Notice of Allowance.
U.S. Appl. No. 13/171,735, Jan. 10, 2014, Office Action.
U.S. Appl. No. 13/285,198, Apr. 11, 2014, Notice of Allowance.
U.S. Appl. No. 13/292,491, Mar. 21, 2014, Office Action.
U.S. Appl. No. 13/027,954, Mar. 10, 2014, Office Action.
U.S. Appl. No. 13/690,397, Mar. 12, 2014, Notice of Allowance.
U.S. Appl. No. 13/917,952, Feb. 26, 2014, Notice of Allowance.
U.S. Appl. No. 13/292,900, Jan. 30, 2014, Notice of Allowance.
U.S. Appl. No. 12/961,787, Apr. 11, 2014, Office Action.
U.S. Appl. No. 13/323,138, Mar. 12, 2014, Notice of Allowance.
U.S. Appl. No. 13/953,453, Mar. 18, 2014, Office Action.

(56) References Cited

OTHER PUBLICATIONS

Declaration of Prior Sales of Terracut PDCS executed by Kenneth E. Bertagnolli Feb. 3, 2011.
Declaration of Prior Sales of Terracut PDCS executed by Paul D. Jones Feb. 3, 2011.
Ekimov, E.A., et al. "Mechanical Properties and Microstructure of Diamond-SiC Nanocomposites" Inorganic Materials, vol. 38, No. 11, 2002, pp. 1117-1122.
International Search Report and Written Opinion for PCT International Application No. PCT/US2007/024090; Apr. 15, 2008.
International Search Report and Written Opinion from International Application No. PCT/US2011/060380 dated Mar. 12, 2012.
U.S. Appl. No. 11/983,619, May 26, 2010, Restriction Requirement.
U.S. Appl. No. 11/983,619, Aug. 9, 2010, Office Action.
U.S. Appl. No. 11/983,619, Mar. 28, 2011, Office Action.
U.S. Appl. No. 11/983,619, Jun. 16, 2011, Notice of Allowance.
U.S. Appl. No. 11/983,619, Sep. 21, 2011, Issue Notification.
U.S. Appl. No. 12/271,081, Dec. 22, 2010, Restriction Requirement.
U.S. Appl. No. 12/271,081, Mar. 31, 2011, Office Action.
U.S. Appl. No. 12/271,081, Aug. 8, 2011, Office Action.
U.S. Appl. No. 12/271,081, Oct. 5, 2011, Notice of Allowance.
U.S. Appl. No. 14/297,359, filed Jun. 5, 2014, Miess et al.
U.S. Appl. No. 14/327,264, filed Jul. 9, 2014, Sani.
U.S. Appl. No. 14/330,851, filed Jul. 14, 2014, Sani.
U.S. Appl. No. 12/548,584, Jun. 25, 2014, Issue Notification.
U.S. Appl. No. 13/027,954, Jun. 3, 2014, Notice of Allowance.
U.S. Appl. No. 13/690,397, Jul. 9, 2014, Issue Notification.
U.S. Appl. No. 13/917,952, Jun. 11, 2014, Issue Notification.
U.S. Appl. No. 13/292,900, May 28, 2014, Issue Notification.
U.S. Appl. No. 13/397,971, Jun. 19, 2014, Office Action.
U.S. Appl. No. 13/953,453, Jun. 24, 2014, Notice of Allowance.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 14/495,759, filed Sep. 24, 2014, Sani.
U.S. Appl. No. 14/504,253, filed Oct. 1, 2014, Bertagnolli et al.
U.S. Appl. No. 14/512,007, filed Oct. 10, 2014, Bertagnolli et al.
U.S. Appl. No. 13/032,350, Aug. 13, 2014, Issue Notification.
U.S. Appl. No. 13/171,735, Aug. 6, 2014, Issue Notification.
U.S. Appl. No. 13/285,198, Jul. 30, 2014, Issue Notification.
U.S. Appl. No. 13/292,491, Aug. 8, 2014, Office Action.
U.S. Appl. No. 13/292,491, Nov. 3, 2014, Office Action.
U.S. Appl. No. 13/027,954, Sep. 12, 2014, Notice of Allowance.
U.S. Appl. No. 13/323,138, Jul. 29, 2014, Notice of Allowance.
U.S. Appl. No. 13/323,138, Nov. 25, 2014, Issue Notification.
U.S. Appl. No. 13/397,971, Nov. 26, 2014, Notice of Allowance.
U.S. Appl. No. 13/953,453, Feb. 12, 2015, Notice of Allowance.
U.S. Appl. No. 13/953,453, Feb. 25, 2015, Issue Notification.

* cited by examiner

POLYCRYSTALLINE DIAMOND COMPACT INCLUDING A POLYCRYSTALLINE DIAMOND TABLE CONTAINING ALUMINUM CARBIDE THEREIN AND APPLICATIONS THEREFOR

CROSS-REFERENCE TO RELATED APPLICATIONS

This application is a continuation-in-part of U.S. patent application Ser. No. 13/027,954 filed on 15 Feb. 2011, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may also be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metallic catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in the formation of a matrix of bonded diamond grains having diamond-to-diamond bonding therebetween, with interstitial regions between the bonded diamond grains being occupied by the metal-solvent catalyst.

The presence of the metal-solvent catalyst in the PCD table is believed to reduce the thermal stability of the PCD table at elevated temperatures. For example, some of the diamond grains can undergo a chemical breakdown or back-conversion to a non-diamond form of carbon via interaction with the metal-solvent catalyst. At elevated high temperatures, portions of diamond grains may transform to carbon monoxide, carbon dioxide, graphite, or combinations thereof, causing degradation of the mechanical properties of the PCD table.

Despite the availability of a number of different PDCs, manufacturers and users of PDCs continue to seek PDCs that exhibit improved toughness, wear resistance, thermal stability, or combinations of the foregoing.

SUMMARY

Embodiments of the invention relate to a PDC comprising a PCD table including bonded-together diamond grains having aluminum carbide disposed interstitially between the bonded-together diamond grains, and methods of fabricating such PDCs. The presence of the aluminum carbide enhances the wear resistance and/or thermal stability of the PCD table compared to if cobalt or other metal-solvent catalyst were present. The PDCs disclosed herein may be used in a variety of applications, such as rotary drill bits, bearing apparatuses, wire-drawing dies, machining equipment, and other articles and apparatuses.

In an embodiment, a PDC includes a substrate, and a PCD table bonded to the substrate. The PCD table includes a plurality of bonded-together diamond grains defining a plurality of interstitial regions. The PCD table further includes aluminum carbide disposed in at least a portion of the plurality of interstitial regions between the bonded-together diamond grains.

In an embodiment, a method of manufacturing a PDC in a single-step HPHT process is disclosed. The method includes forming an assembly including an aluminum material and a plurality of diamond particles. The method further includes subjecting the assembly to an HPHT process to form a PCD table including a plurality of bonded-together diamond grains defining a plurality of interstitial regions. The act of subjecting the assembly to the HPHT process includes sintering at least a portion of the plurality of diamond particles in the presence of the aluminum material to form aluminum carbide disposed in at least a portion of the plurality of interstitial regions of the PCD table.

In an embodiment, a method of manufacturing a PDC includes forming an assembly including an at least partially leached PCD table including a plurality of interstitial regions therein positioned at least proximate to an aluminum-material layer exhibiting a thickness of about 10 μm to about 750 μm. The method further includes infiltrating aluminum material from the aluminum-material layer into at least a portion of the interstitial regions of a selected region of the at least partially leached PCD table.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to a PDC comprising a PCD table including bonded-together diamond grains having aluminum carbide disposed interstitially between the bonded-together diamond grains, and methods of fabricating such PDCs. The presence of the aluminum carbide enhances the wear resistance and/or thermal stability of the PCD table compared to if cobalt or other metal-solvent catalyst were present. The PDCs disclosed herein may be used in a variety of applications, such as rotary drill bits, bearing apparatuses, wire-drawing dies, machining equipment, and other articles and apparatuses.

Figure 1A:
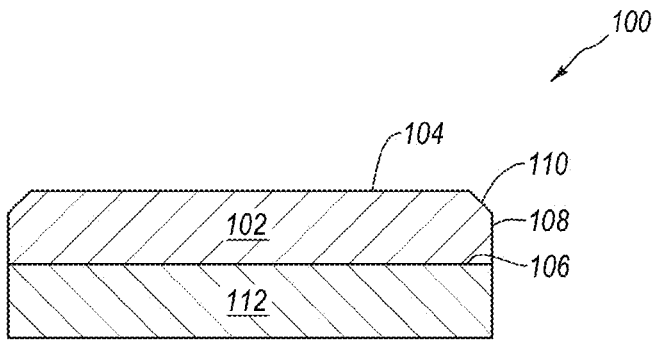
FIG. 1A is a cross-sectional view of an embodiment of a PDC including a PCD table having aluminum carbide disposed therein.
Figure 1B:
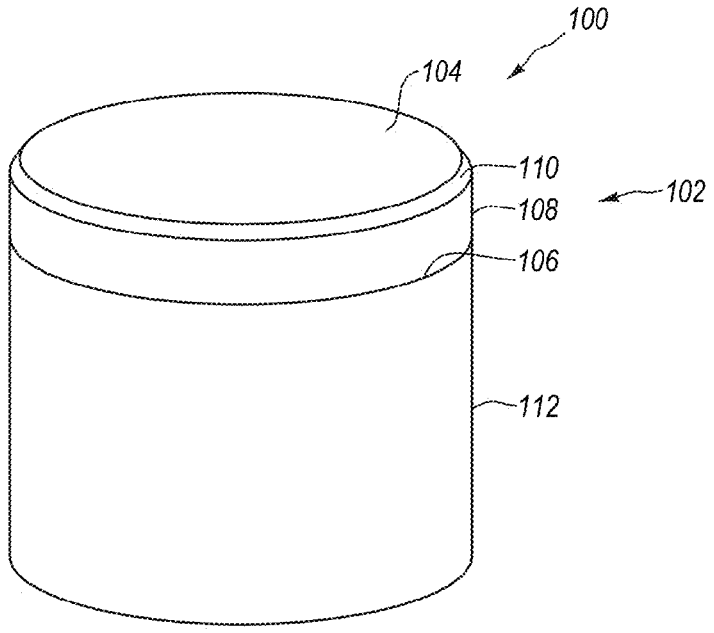
FIG. 1B is an isometric view of the PDC shown in FIG. 1A.

FIGS. 1A and 1B are cross-sectional and isometric views, respectively, of an embodiment of a PDC 100 including a PCD table 102 having aluminum carbide (e.g., $Al_4C_3$ and/or other stoichiometry) disposed therein. The PCD table 102 includes a working upper surface 104, a generally opposing interfacial surface 106, and at least one lateral surface 108 extending therebetween. An optional chamfer 110 or other edge geometry may also extend between the upper surface 104 and the at least one lateral surface 108. It is noted that at least a portion of the at least one lateral surface 108 and/or the chamfer 110 may also function as a working surface that contacts a subterranean formation during drilling.

The interfacial surface 106 of the PCD table 102 is bonded to an aluminum-based substrate 112. For example, the aluminum-based substrate 112 may comprise any suitable aluminum material, such as a commercially pure aluminum or an aluminum alloy (e.g., ASTM standard alloys) such as aluminum-magnesium-silicon alloys, aluminum-zinc-magnesium alloys, aluminum-zinc-magnesium-copper alloys, or another suitable aluminum alloy. For example, one suitable aluminum-magnesium-silicon alloy is 6061 aluminum having a composition of about 1.0 weight % magnesium, 0.6 weight % silicon, 0.2 weight % chromium, 0.27 weight % copper, with the balance being aluminum. Although the interfacial surface 106 of the PCD table 102 is depicted in FIG. 1A as being substantially planar, in other embodiments, the interfacial surface 106 may exhibit a selected nonplanar topography and the aluminum-based substrate 112 may exhibit a correspondingly configured interfacial surface.

The PCD table 102 includes a plurality of bonded-together diamond grains defining a plurality of interstitial regions. A portion of, or substantially all of, the interstitial regions includes the aluminum carbide disposed therein. In some embodiments, the aluminum carbide is formed by infiltration of aluminum from the aluminum-based substrate 112 during an HPHT process that reacts with the diamond grains and/or another carbon source to form aluminum carbide. In other embodiments, aluminum material may be mixed with the diamond particles to be HPHT processed, which reacts with the diamond grains and/or another carbon source during HPHT processing to form aluminum carbide.

Depending on the amount of aluminum carbide in the PCD table 102, the diamond grains may be directly bonded-together via diamond-to-diamond bonding (e.g., $sp^3$ bonding) therebetween, may be bonded together by the aluminum carbide without direct bonding therebetween, or combinations thereof. For example, when relatively low amounts of the aluminum carbide are present in the PCD table 102, the bonded-together diamond grains may exhibit a significant amount of diamond-to-diamond bonding, while the bonded-together diamond grains may exhibit less or significantly no diamond-to-diamond bonding when relatively greater amounts of the aluminum carbide are present in the PCD table 102. In an embodiment, the PCD table 102 may be integrally formed on the aluminum-based substrate 112 (i.e., diamond particles are sintered on or near the aluminum-based substrate 112 to form the PCD table 102). In another embodiment, the PCD table 102 is a pre-sintered PCD table 102 that is infiltrated with aluminum material from the aluminum-based substrate 112 and attached to the aluminum-based substrate 112.

In the embodiment(s) where diamond particles are sintered in the presence of aluminum and/or aluminum carbide, the aluminum carbide may be present in the resulting PCD table 102 in an amount of about 1 weight % to about 20 weight %, about 2 weight % to about 20 weight %, about 6 weight % to about 15 weight %, about 8 weight % to about 18 weight %, about 10 weight % to about 20 weight %, about 12 weight % to about 18 weight %, or about 15 weight % to about 18 weight % of the PCD table 102, with the balance substantially being diamond grains. In the embodiment(s) where aluminum is introduced into a pre-sintered diamond table (i.e., a diamond table sintered with a solvent catalyst) and reacts to form aluminum carbide, the aluminum carbide may be present in the PCD table 102 in an amount of about 1 weight % to about 10 weight %, about 1 weight % to about 8 weight %, about 2 weight % to about 5 weight %, about 3 weight % to about 8 weight %, about 4 weight % to about 8 weight %, about 4 weight % to about 6 weight %, or about 4 weight % to about 5 weight % of the PCD table 102, with the balance substantially being diamond grains. As aluminum carbide may not effectively catalyze PCD growth, the PCD table 102 is relatively thermally-stable and exhibits improved wear resistance and/or thermal stability compared to if the PCD table 102 included a metal-solvent catalyst (e.g., cobalt) therein instead of the aluminum carbide. When the PCD table 102 is a pre-sintered PCD table, a residual amount of metallic catalyst may also be present in the interstitial regions of the PCD table 102 that was used to initially catalyze formation of diamond-to-diamond bonding between the diamond grains of the PCD table 102. Prior to re-infiltration with aluminum, the residual metallic catalyst may comprise iron, nickel, tungsten, cobalt, or alloys thereof. For example, the residual metallic catalyst may be present in the PCD table 102 in amount of about 2 weight % or less, about 0.8 weight % to about 1.50 weight %, or about 0.86 weight % to about 1.47 weight %.

It is known that in the presence of water, aluminum carbide may partially decompose into methane and aluminum hydroxide. The chemical reaction is:

$$Al_4C_3+12H_2O\rightarrow 4Al(OH)_3+3CH_4$$

Figure 2:
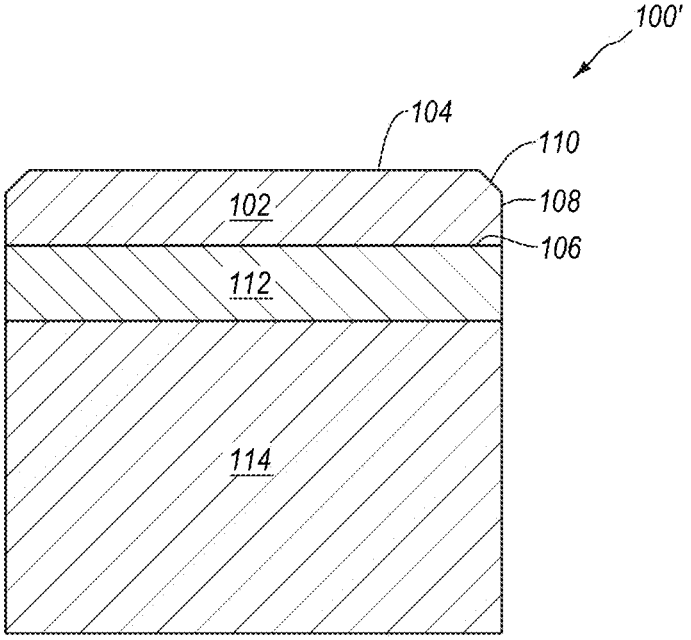
FIG. 2 is a cross-sectional view of an embodiment of a PDC that includes a carbide-substrate extension bonded to the aluminum-based substrate shown in FIGS. 1A and 1B.

FIG. 2 is a cross-sectional view of a PDC 100' according to another embodiment. The PDC 100' includes a carbide-substrate extension 114 bonded to the aluminum-based substrate 112. For example, the carbide-substrate extension 114 may include, without limitation, cemented carbides, such as tungsten carbide, titanium carbide, chromium carbide, niobium carbide, tantalum carbide, vanadium carbide, or combinations thereof cemented with a metallic cementing constituent, such as iron, nickel, cobalt, or alloys thereof. In an embodiment, the carbide-substrate extension 114 comprises cobalt-cemented tungsten carbide. The carbide-substrate extension 114 may be relatively easier to braze to a structure, such as bit body of a rotary drill bit, than the aluminum-based substrate 112.

Figure 3A:
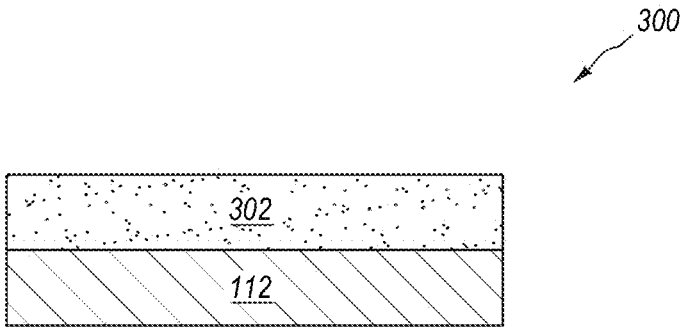
FIG. 3A is an assembly that may be HPHT processed to form the PDC shown in FIG. 1A according to an embodiment.

FIG. 3A is an assembly 300 that may be HPHT processed to form the PDC 100 shown in FIG. 1A according to an embodiment. The assembly 300 includes at least one layer 302 including diamond particles disposed adjacent to the aluminum-based substrate 112.

The assembly 300 may be placed in a pressure transmitting medium (e.g., a refractory-metal can embedded in pyrophyllite or other pressure transmitting medium) to form a cell assembly. The cell assembly, including the assembly 300, may be subjected to an HPHT process using an ultra-high pressure press (e.g., a cubic press) to create temperature and pressure conditions at which diamond is stable. The temperature of the HPHT process may be at least about 1000° C. (e.g., about 1200° C. to about 1600° C., about 1200° C. to about 1300° C., or about 1600° C. to about 2300° C.). and the pressure of the HPHT process may be at least 4.0 GPa (e.g., about 5.0 GPa to about 10.0 GPa, about 5.0 GPa to about 8.0 GPa, or about 7.5 GPa to about 9.0 GPa) for a time sufficient to at least partially melt and infiltrate the at least one layer 302 with an aluminum material (e.g., aluminum or an aluminum alloy) from the aluminum-based substrate 112. The pressure values referred to herein in any of the embodiments refer to the pressure in the pressure transmitting medium of the cell assembly (i.e., cell pressure) at room temperature (e.g., about 25° C.). The actual pressure in the pressure transmitting medium at sintering temperature may be slightly higher. Optionally, methods and apparatuses for sealing enclosures suitable for holding the assembly 300 are disclosed in U.S. patent application Ser. No. 11/545,929, which is incorporated herein, in its entirety, by this reference.

The aluminum material is capable of infiltrating and/or wetting the diamond grains to fill the interstitial regions between un-sintered diamond particles of the at least one layer 302. During the HPHT process, the aluminum material may react with the diamond particles and/or another carbon source to form aluminum carbide that is disposed interstitially between the diamond grains of the PCD table 102 so-formed. After formation of the PCD table 102, the PDC 100 may be subjected to further processing, if desired or needed, such as lapping, grinding, and/or machining to form the chamfer 110, upper working surface 104, and/or other geometrical features.

The diamond particles of the at least one layer 302 that ultimately form part of the PCD table 102 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 10 μm and another portion exhibiting a relatively smaller size between about 10 μm and about 2 μm. Of course, the plurality of diamond particles may also comprise three or more different sizes (e.g., one relatively larger size and two or more relatively smaller sizes), without limitation.

Figure 3B:
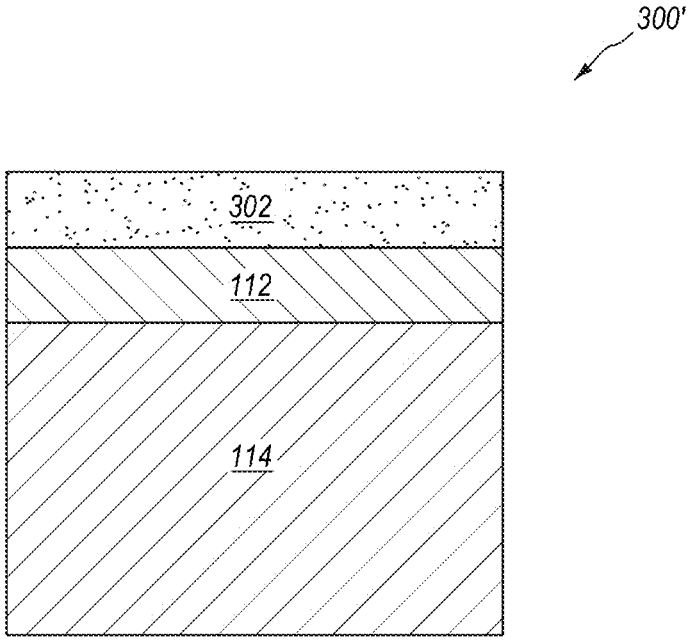
FIG. 3B is an assembly that may be HPHT processed to form the PDC shown in FIG. 2 according to an embodiment.

FIG. 3B is an assembly 300' that may be HPHT processed to form the PDC 100 shown in FIG. 2 according to an embodiment. The assembly 300' includes the at least one layer 302 including the diamond particles, the carbide-substrate extension 114, and the aluminum-based substrate 112 disposed between the at least one layer 302 and the carbide-substrate extension 114. The assembly 300' may be HPHT processed using the same or similar HPHT conditions used to process the assembly 300 shown in FIG. 3A. The volume of the aluminum-based substrate 112 is chosen so that substantially only the aluminum material from the aluminum-based substrate 112 and not any metal-solvent catalyst from the carbide-substrate extension 114 infiltrates into the at least one layer 302 during HPHT processing. For example, the cementing constituent (e.g., cobalt from a cobalt-cemented tungsten carbide substrate) may at least partially melt during HPHT processing of the assembly 300', but infiltration of the aluminum material from the aluminum-based substrate 112 effectively blocks infiltration of the cementing constituent into the diamond particles of the at least one layer 302.

Figure 4A:
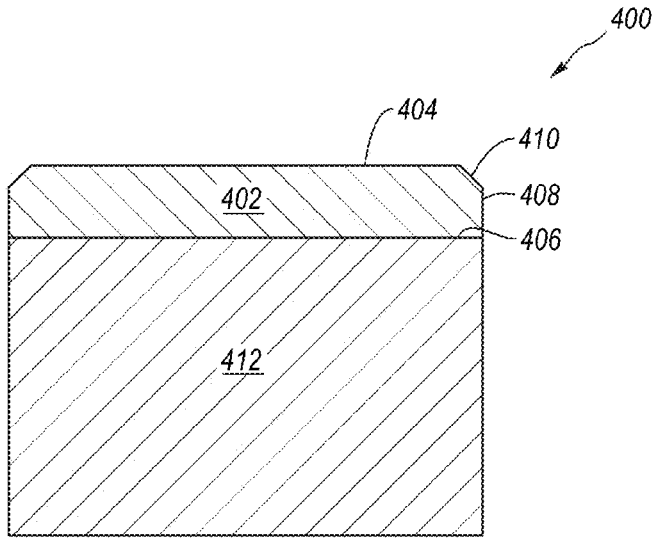
FIG. 4A is a cross-sectional view of an embodiment of a PDC including a PCD table having aluminum carbide disposed therein, which is directly bonded to a cemented carbide substrate.

FIG. 4A is a cross-sectional view of an embodiment of a PDC 400 including a PCD table 402 having aluminum carbide disposed therein, which is directly bonded to a cemented carbide substrate 412. The PCD table 402 includes a working upper surface 404, a generally opposing interfacial surface 406, and at least one lateral surface 408 extending therebetween. An optional chamfer 410 or other edge geometry may also extend between the upper surface 404 and the at least one lateral surface 408. It is noted that at least a portion of the at least one lateral surface 408 and/or the chamfer 410 may also function as a working surface that contacts a subterranean formation during drilling.

The interfacial surface 406 of the PCD table 402 is directly bonded to the cemented carbide substrate 412. For example, the cemented carbide substrate 412 may include, without limitation, cemented carbides, such as tungsten carbide, titanium carbide, chromium carbide, niobium carbide, tantalum carbide, vanadium carbide, or combinations thereof cemented with a metallic cementing constituent, such as iron, nickel, cobalt, or alloys thereof. In an embodiment, the cemented carbide substrate 412 comprises cobalt-cemented tungsten carbide. Although the interfacial surface 406 of the PCD table 402 is depicted in FIG. 4A as being substantially planar, in other embodiments, the interfacial surface 406 may exhibit a selected nonplanar topography and the cemented carbide substrate 412 may exhibit a correspondingly configured interfacial surface.

The PCD table 402 includes a plurality of bonded-together diamond grains defining a plurality of interstitial regions. A portion of, or substantially all of, the interstitial regions includes aluminum carbide disposed therein. In some embodiments, the aluminum carbide is formed by infiltration of aluminum from the aluminum-based substrate 412 during HPHT process that reacts with the diamond grains and/or another carbon source to form aluminum carbide. In other embodiments, aluminum may be mixed with the diamond particles to be HPHT processed, which reacts with the diamond grains and/or another carbon source during HPHT processing to form aluminum carbide.

Depending on the amount of aluminum carbide in the PCD table 402, the diamond grains may be directly bonded-together via diamond-to-diamond bonding (e.g., $sp^3$ bonding) therebetween, may be bonded together by the aluminum carbide without direct bonding therebetween, or combinations thereof. For example, when relatively low amounts of the aluminum carbide are present in the PCD table 402, the bonded-together diamond grains may exhibit a significant amount of diamond-to-diamond bonding, while the bonded-together diamond grains may exhibit less or no diamond-to-diamond bonding when relatively greater amounts of the aluminum carbide are present in the PCD table 402. In an embodiment, the PCD table 402 may be integrally formed on the cemented carbide substrate 412 (i.e., diamond particles are sintered on or near the cemented carbide substrate 412 to form the PCD table 402). In another embodiment, the PCD table 402 is a pre-sintered PCD table 402 that is infiltrated with aluminum from a source other than the cemented carbide substrate 412 and attached to the cemented carbide substrate 412.

In the embodiment(s) where diamond particles are sintered in the presence of aluminum and/or aluminum carbide, the aluminum carbide may be present in the resulting PCD table 102 in an amount of about 1 weight % to about 20 weight %, about 2 weight % to about 20 weight %, about 6 weight % to about 15 weight %, about 8 weight % to about 18 weight %, about 10 weight % to about 20 weight %, about 12 weight % to about 18 weight %, or about 15 weight % to about 18 weight % of the PCD table 102, with the balance substantially being diamond grains. In the embodiment(s) where aluminum is introduced into a pre-sintered diamond table (i.e., a diamond table sintered with a solvent catalyst) and reacts to form aluminum carbide, the aluminum carbide may be present in the PCD table 102 in an amount of about 1 weight % to about 10 weight %, about 1 weight % to about 8 weight %, about 2 weight % to about 5 weight %, about 3 weight % to about 8 weight %, about 4 weight % to about 8 weight %, about 4 weight % to about 6 weight %, or about 4 weight % to about 5 weight % of the PCD table 102, with the balance substantially being diamond grains. When the PCD table 402 is a pre-sintered PCD table, a residual amount of metallic catalyst may also be present in the interstitial regions of the PCD table 402 that was used to initially catalyze formation of diamond-to-diamond bonding between the diamond grains of the PCD table 402. The residual metallic catalyst may comprise iron, nickel, cobalt, or alloys thereof. For example, the residual metallic catalyst may be present in the PCD table 402 in amount of about 2 weight % or less, about 0.8 weight % to about 1.50 weight %, or about 0.86 weight % to about 1.47 weight %.

Figure 4B:
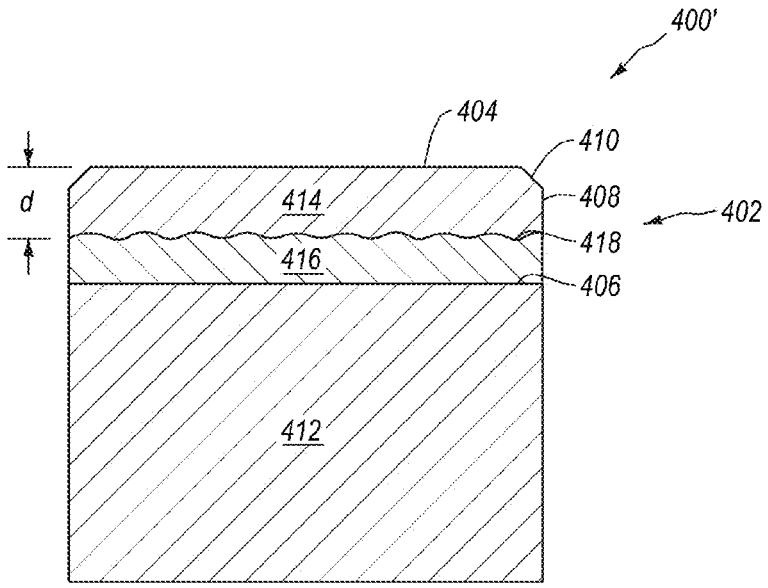
FIG. 4B is a cross-sectional view of another embodiment of the PDC shown in FIG. 4A in which the PCD table thereof includes a metallic constituent from the cemented carbide substrate in addition to aluminum carbide.

FIG. 4B is a cross-sectional view of another embodiment of a PDC 400' in which the PCD table 402 is also infiltrated with a metallic constituent from the cemented carbide substrate 412 in addition to aluminum from a source of aluminum material. In the illustrated embodiment shown in FIG. 4B, the PCD table 402 includes a thermally-stable first region 414 that extends inwardly from the upper surface 404 to a depth "d" and the chamfer 410, and a second region 416 that extends inwardly from the back surface 406 that is bonded to the cemented carbide substrate 412. The first region 414 includes the aluminum carbide disposed interstitially between the bonded-together diamond grains and the second region 416 includes a metallic constituent infiltrated from the cemented carbide substrate 412. For example, the cobalt, iron, nickel, or alloys thereof from the cemented carbide substrate 412 (e.g., cobalt from a cobalt-cemented tungsten carbide substrate) may infiltrate into the second region 416.

When the PCD table 402 is integrally formed with the cemented carbide substrate 412 from sintering diamond powder on the cemented carbide substrate 412, the second region 416 may exhibit a significant amount of diamond-to-diamond bonding between the bonded-together diamond grains thereof. If the bonded-together diamond grains of the first region 414 exhibit some diamond-to-diamond bonding, the diamond-to-diamond bonding present in the second region 416 may be relatively greater than that of the first region 414.

A nonplanar boundary 418 may be formed between the first region 414 and the second region 416 of the PCD table 402. The nonplanar boundary 418 exhibits a geometry characteristic of the metallic constituent being only partially infiltrated into the second region 416 of the PCD table 402.

In an embodiment, the depth "d" to which the first region 414 extends may be almost the entire thickness of the PCD table 402. In another embodiment, the depth "d" may be an intermediate depth within the PCD table 402 of about 50 μm to about 500 μm, about 200 μm to about 400 μm, about 300 μm to about 450 μm, about 550 μm to about 750 μm, about 0.2 mm to about 2.0 mm, about 0.5 mm to about 1.5 mm, about 0.5 mm to about 1.0 mm, about 0.65 mm to about 0.9 mm, or about 0.75 mm to about 0.85 mm. As the depth "d" of the first region 414 increases, the wear resistance and/or thermal stability of the PCD table 402 may increase. However, strong bonding between the PCD table 402 and the cemented carbide substrate 412 may be maintained by having the second region 416 having a sufficient thickness. For example, in some embodiments, the depth "d" may be about 0.5 to about 0.9 times the thickness of the PCD table 402, such as about 0.55 to about 0.8 (e.g., about 0.55 to about 0.67) times the thickness of the PCD table 402.

Figure 5A:
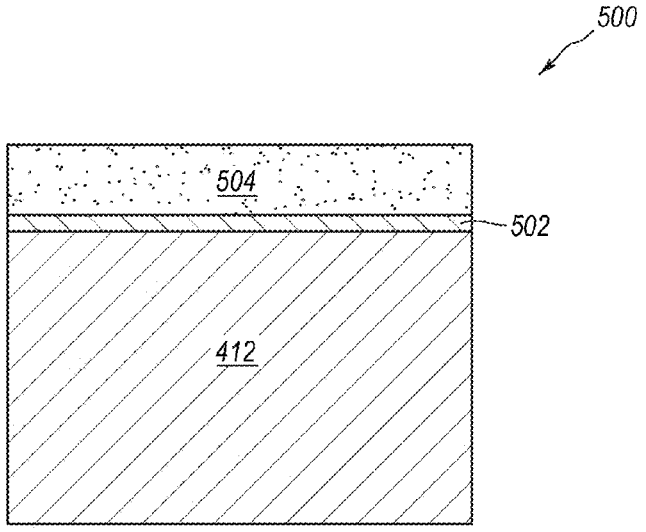
FIG. 5A is a cross-sectional view of an assembly that may be HPHT processed to form the PDCs shown in FIGS. 4A and 4B according to one or more embodiments.

FIG. 5A is an assembly 500 that may be HPHT processed to form the PDCs 400 and 400' shown in FIGS. 4A and 4B according to one or more embodiments. The assembly 500 includes an aluminum-material layer 502 disposed between at least one layer 504 including diamond particles and the cemented carbide substrate 412. For example, the aluminum-material layer 502 may be in the form of foil, a sheet (e.g., a thin disc), a green body of aluminum material (e.g., an aluminum powder held together by a polymer, held together by another binder, or formed via a tape casting process), or combinations of the foregoing and made from any of the aluminum materials disclosed herein. The aluminum-material layer 502 may exhibit a thickness "t" of about 5 μm to about 750 μm, such as about 10 μm to about 110 μm, about 10 μm to about 40 μm (e.g., about 25 μm), about 40 μm to about 60 μm (e.g., about 50 μm), about 50 μm to about 90 μm (e.g., about 75 μm), about 60 μm to about 100 μm, about 60 μm to about 90 μm, about 90 μm to about 110 μm (e.g., about 100 μm), about 110 μm to about 200 μm, about 200 μm to about 500 μm, about 500 μm to about 750 μm. The diamond particles of the at least one layer 504 may exhibit any of the selected sizes and distributions discussed about with respect to the diamond particles of the at least one layer 302 shown in FIG. 3A.

The assembly 500 may be placed in a pressure transmitting medium (e.g., a refractory-metal can embedded in pyrophyllite or other pressure transmitting medium) to form a cell assembly. The cell assembly, including the assembly 500, may be subjected to an HPHT process using the same or similar HPHT process conditions used to process the assembly 300 shown in FIG. 3A.

During the HPHT process, an aluminum material (e.g., aluminum or any of the disclosed aluminum alloys) from the aluminum-material layer 502 at least partially melts and infiltrates into the diamond particles of the at least one layer 504. The aluminum material is capable of infiltrating and/or wetting the diamond grains to fill the interstitial regions between un-sintered diamond particles of the at least one layer 302. During the HPHT process, the aluminum material may react with the diamond particles and/or another source of carbon to form aluminum carbide that is disposed interstitially between the diamond grains of the PCD table 402 so-formed.

Referring also to the embodiment shown in FIG. 4A in addition to FIG. 5A, the volume of the aluminum material may be selected to substantially fill the interstitial regions between the diamond particles of the at least one layer 504 so that infiltration of a metallic constituent (e.g., cobalt from a cobalt-cemented tungsten carbide substrate) is effectively blocked from infiltrating into the at least one layer 504 during HPHT processing. However, a small indeterminate amount of the metallic constituent along the interface between the PCD table 402 and the cemented carbide substrate 412 may form a metallurgical bond between the PCD table 402 and the cemented carbide substrate 412.

Referring also to the embodiment shown in FIG. 4B in addition to FIG. 5A, the volume of the aluminum material may be selected to only fill a selected portion the interstitial regions between the diamond particles of the at least one layer 504. In this embodiment, infiltration of a metallic constituent (e.g., cobalt from a cobalt-cemented tungsten carbide substrate) is not completely blocked from infiltrating into the at least one layer 504. During HPHT processing, the aluminum material from the aluminum-material layer 502 liquefies and infiltrates into a region of the at least one layer 504 before infiltration of the metallic constituent from the cemented carbide substrate 412, which ultimately forms the first region 414 (FIG. 4B). In such an embodiment, the metallic constituent from the cemented carbide substrate 412 (e.g., cobalt from a cobalt-cemented tungsten carbide substrate) infiltrates into another region of the at least one layer 504 which ultimately forms the second region 416 (FIG. 4B). The metallic constituent acts as a metal-solvent catalyst that effectively catalyzes formation of diamond-to-diamond bonding in the second region 416 (FIG. 4B).

Figure 5B:
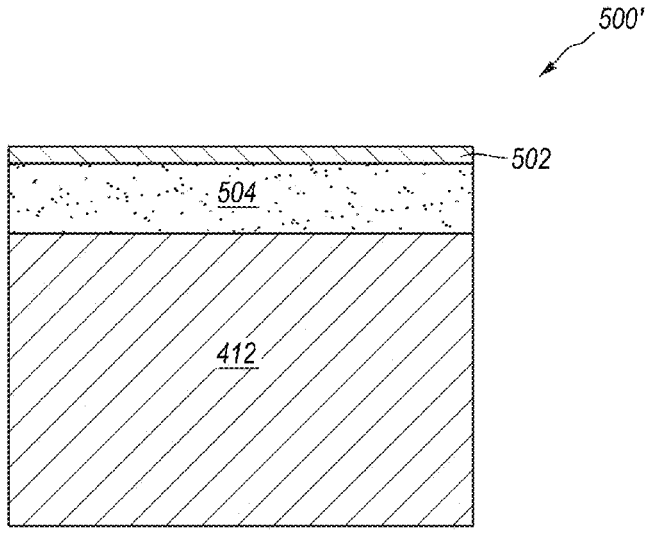
FIG. 5B is an assembly that may be HPHT processed to form the PDCs and shown in FIGS. 4A and 4B according to one or more additional embodiments.

FIG. 5B is an assembly 500' that may be HPHT processed (e.g., as described above relative to assembly 500) to form the PDCs 400 and 400' shown in FIGS. 4A and 4B according to one or more additional embodiments. The assembly 500' differs from the assembly 500 shown in FIG. 5A in that the at least one layer 504 including diamond particles is disposed between the aluminum-material layer 502 and the cemented carbide substrate 412.

Figure 6:
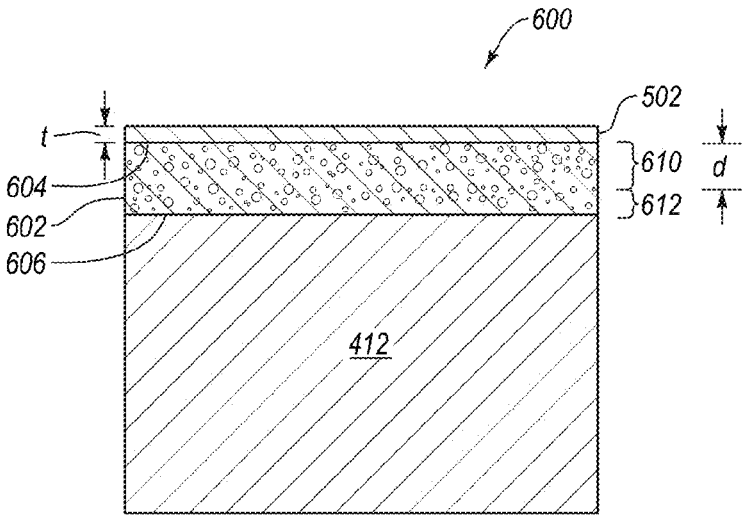
FIG. 6 is a cross-sectional view of an assembly to be processed under HPHT conditions to form the PDCs shown in FIGS. 4A and 4B according to another embodiment of a method.

As an alternative or in addition to using the aluminum-material layer 502, in other embodiments, aluminum material (e.g., commercially pure aluminum or an aluminum alloy) may be provided in particulate form and mixed with the diamond particles to form a mixture that is HPHT processed. The aluminum material may comprise about 1 weight % to about 20 weight %, 0.75 weight % to about 15 weight %, about 2 weight % to about 20 weight %, about 1.5 weight % and about 15 weight %, about 6 weight % to about 15 weight %, about 4.5 weight % to about 11 weight %, about 8 weight % to about 18 weight %, about 6 weight % to about 13.5 weight %, about 10 weight % to about 20 weight %, about 7.5 weight % to about 15 weight %, about 12 weight % to about 18 weight %, about 9 weight % to about 13.5 weight %, about 15 weight % to about 18 weight %, or about 11 weight % to about 13.5 weight % of the PCD table 102, with the balance substantially being diamond grains FIG. 6 is a cross-sectional view of an assembly 600 to be processed under HPHT conditions to form the PDCs 400 and 400' shown in FIGS. 4A and 4B according to yet another embodiment of a method. The method described with respect to the assembly 600 employs an at least partially leached PCD table (e.g., $sp^3$ bonded) instead of un-sintered diamond particles (e.g. diamond powder) for forming the PCD table 402 of the PDCs 400 and 400'. The assembly 600 includes an at least partially leached PCD table 602 disposed between the cemented carbide substrate 412 and the aluminum-material layer 502 exhibiting any of the previously disclosed thicknesses. The at least partially leached PCD table 602 includes an upper surface 604 and a back surface 606. The at least partially leached PCD table 602 also includes a plurality of interstitial regions that were previously completely occupied by a metallic catalyst and forms a network of at least partially interconnected pores that extend between the upper surface 604 and the back surface 606.

The assembly 600 may be placed in a pressure transmitting medium (e.g., a refractory-metal can embedded in pyrophyllite or other pressure transmitting medium) to form a cell assembly. The cell assembly, including the assembly 600, may be subjected to an HPHT process using the same or similar HPHT process conditions used to process the assembly 300 shown in FIG. 3A. During the HPHT process, aluminum material from the aluminum-material layer 502 and the metallic constituent from the cemented carbide substrate 412 at least partially melt and infiltrate into the at least partially leached PCD table 602. During the HPHT process, the aluminum material from the aluminum-material layer 502 at least partially melts and infiltrates into a first region 610 of the at least partially leached PCD table 602 prior to or substantially simultaneously with the metallic constituent from the cemented carbide substrate 412 at least partially melting and infiltrating into a second region 612 of the at least partially leached PCD table 602 that is located adjacent to the cemented carbide substrate 412. Upon cooling from the HPHT process, the metallic constituent forms a strong metallurgical bond between the second region 612 and the cemented carbide substrate 412. During the HPHT process, the infiltrated aluminum material reacts with the diamond grains and/or another carbon source of the at least partially leached PCD table 602 to form aluminum carbide that is disposed interstitially between the diamond grains thereof.

The extent to which the metallic constituent infiltrates into the at least partially leached PCD table 602, if any, depends on the porosity of the at least partially leached PCD table 602 and the volume of the aluminum-material layer 502. By properly selecting the volume of the aluminum-material layer 502 and porosity of the at least partially leached PCD table 602, the depth "d" shown in FIG. 4B may be appropriately controlled.

Referring to FIG. 4A along with FIG. 6, in some embodiments, the depth "d" extends the entire thickness of the PCD table 402 or almost the entire thickness of the PCD table 402. However, the metallic constituent may still form a strong metallurgical bond between the cemented carbide substrate 412 and a portion of the diamond grains of the second region 416 even when the metallic constituent is located just along or near the interface between the PCD table 402 and the cemented carbide substrate 412.

The at least partially leached PCD table 602 shown in FIG. 6 may be fabricated by enclosing a plurality of diamond particles with a metallic catalyst (e.g., cobalt, nickel, iron, or alloys thereof) in a pressure transmitting medium (e.g., a refractory-metal can embedded in pyrophyllite or other pressure transmitting medium) to form a cell assembly and subjecting the cell assembly including the contents therein to an HPHT sintering process to sinter the diamond particles and form a PCD body comprised of bonded-together diamond grains that exhibit diamond-to-diamond bonding (e.g., $sp^3$ bonding) therebetween. Any of the diamond-stable HPHT process conditions disclosed herein may be employed for the HPHT sintering conditions. For example, the metallic catalyst may be mixed with the diamond particles, infiltrated from a metallic catalyst foil or powder adjacent to the diamond particles, provided and infiltrated from a cemented carbide substrate (e.g., cobalt from a cobalt cemented tungsten carbide substrate), or combinations of the foregoing. The bonded-together diamond grains define interstitial regions, with the metallic catalyst disposed within at least a portion of the interstitial regions. The diamond particles may exhibit a single-mode diamond particle size distribution, or a bimodal or greater diamond particle size distribution. The as-sintered PCD body may be leached by immersion in an acid, such as aqua regia, nitric acid, hydrofluoric acid, mixtures of the foregoing, or subjected to another suitable process to remove at least a portion of the metallic catalyst from the interstitial regions of the PCD body and form the at least partially leached PCD table 602. For example, the as-sintered PCD body may be immersed in the acid for about 2 to about 7 days (e.g., about 3, 5, or 7 days) or for a few weeks (e.g., about 4 weeks) depending on the process employed. It is noted that when the metallic catalyst is infiltrated into the diamond particles from a cemented tungsten carbide substrate including tungsten carbide particles cemented with a metallic catalyst (e.g., cobalt, nickel, iron, or alloys thereof), the infiltrated metallic catalyst may carry a tungsten-containing material (e.g., tungsten and/or tungsten carbide) therewith and the as-sintered PCD body may include such tungsten-containing material therein disposed interstitially between the bonded diamond grains. Depending upon the leaching process, at least a portion of the tungsten-containing material may not be substantially removed by the leaching process and may enhance the wear resistance of the at least partially leached PCD table 602.

The diamond-stable HPHT sintering process conditions employed to form the as-sintered PCD body may be a temperature of at least about 1000° C. (e.g., about 1200° C. to about 1600° C., about 1200° C. to about 1300° C., or about 1600° C. to about 2300° C.) and a pressure in the pressure transmitting medium of at least about 4.0 GPa (e.g., about 5.0 GPa to about 10.0 GPa, about 5.0 GPa to about 8.0 GPa, or about 7.5 GPa to about 9.0 GPa) for a time sufficient to sinter the diamond particles together in the presence of the metallic catalyst and form the PCD comprising directly bonded-together diamond grains defining interstitial regions occupied by the metal-solvent catalyst. For example, the pressure in the pressure transmitting medium that encloses the diamond particles and metallic catalyst source may be at least about 8.0 GPa, at least about 9.0 GPa, at least about 10.0 GPa, at least about 11.0 GPa, at least about 12.0 GPa, or at least about 14 GPa.

As the sintering pressure employed during the HPHT process used to fabricate the PCD body is moved further into the diamond-stable region away from the graphite-diamond equilibrium line, the rate of nucleation and growth of diamond increases. Such increased nucleation and growth of diamond between diamond particles (for a given diamond particle formulation) may result in the as-sintered PCD body being formed that exhibits one or more of a relatively lower metallic catalyst content, a higher coercivity, a lower specific magnetic saturation, or a lower specific permeability (i.e., the ratio of specific magnetic saturation to coercivity) than PCD formed at a lower sintering pressure.

Generally, as the sintering pressure that is used to form the PCD body increases, the coercivity of the PCD body may increase and the magnetic saturation may decrease. The PCD body defined collectively by the bonded diamond grains and the metallic catalyst may exhibit a coercivity of about 115 Oersteds ("Oe") or more and a metallic catalyst content of less than about 7.5 weight % as indicated by a specific magnetic saturation of about 15 Gauss·$cm^3$/grams ("G·$cm^3$/g") or less. For example, the coercivity of the PCD body may be about 115 Oe to about 250 Oe and the specific magnetic saturation of the PCD body may be greater than 0 G·$cm^3$/g to about 15 G·$cm^3$/g. In an even more detailed embodiment, the coercivity of the PCD body may be about 115 Oe to about 175 Oe and the specific magnetic saturation of the PCD body may be about 5 G·$cm^3$/g to about 15 G·$cm^3$/g. In yet an even more detailed embodiment, the coercivity of the PCD body may be about 155 Oe to about 175 Oe and the specific magnetic saturation of the PCD body may be about 10 G·$cm^3$/g to about 15 G·$cm^3$/g. The specific permeability (i.e., the ratio of specific magnetic saturation to coercivity) of the PCD may be about 0.10 or less, such as about 0.060 G·$cm^3$/Oe·g to about 0.090 G·$cm^3$/Oe·g.

As merely one example, ASTM B886-03 (2008) provides a suitable standard for measuring the specific magnetic saturation and ASTM B887-03 (2008) e1 provides a suitable standard for measuring the coercivity of the PCD. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pa.) is one suitable instrument that may be used to measure the specific magnetic saturation and the coercivity of the PCD.

The pressure values employed in the HPHT processes disclosed herein refer to the pressure in the pressure transmitting medium at room temperature (e.g., about 25° C.) with application of pressure using an ultra-high pressure press and not the pressure applied to the exterior of the cell assembly. The actual pressure in the pressure transmitting medium at sintering temperature may be slightly higher. The ultra-high pressure press may be calibrated at room temperature by embedding at least one calibration material that changes structure at a known pressure such as, PbTe, thallium, barium, or bismuth in the pressure transmitting medium.

Even after leaching, a residual amount of the metallic catalyst may remain in the interstitial regions between the bonded diamond grains of the at least partially leached PCD table 602 that may be identifiable using mass spectroscopy, energy dispersive x-ray spectroscopy microanalysis, or other suitable analytical technique. Such entrapped, residual metallic catalyst is difficult to remove even with extended leaching times. For example, the residual amount of metallic catalyst may be present in an amount of about 4 weight % or less, about 3 weight % or less, about 2 weight % or less, about 0.8 weight % to about 1.50 weight %, or about 0.86 weight % to about 1.47 weight %.

The at least partially leached PCD table 602 may be subjected to at least one shaping process prior to bonding to the cemented carbide substrate 412, such as grinding or lapping, to tailor the geometry thereof (e.g., forming an edge chamfer), as desired, for a particular application. The as-sintered PCD body may also be shaped prior to leaching or bonding to the cemented carbide substrate 412 by a machining process, such as electro-discharge machining.

The plurality of diamond particles sintered to form the at least partially leached PCD table 602 may exhibit any of the disclosed sizes and distributions disclosed for the diamond particles of the at least one layer 302 shown in FIGS. 3A and 3B.

Regardless of whether the PCD table 402 is sintered on the cemented carbide substrate 412 or formed by infiltrating the at least partially leached PCD table 602, the second region 416 of the PCD table 402 in FIG. 4B may exhibit any of the foregoing magnetic characteristics as at least a portion of the interstitial regions thereof may be occupied by a ferromagnetic metallic constituent, such as cobalt from the cemented carbide substrate 412. The high coercivity is indicative of the high strength and density of the diamond-to-diamond bonds between the diamond grains of the PCD table 402. The low magnetic saturation is indicative of a low metallic catalyst content of about 1 weight % to about 7.5 weight %, such as about 3 weight % to about 6 weight %. The magnetic characteristics of the second region 416 may be determined by removing the cemented carbide substrate 412 and the first region 414 via grinding, electro-discharge machining, or another suitable material removal process and magnetically testing the isolated second region 416 of the PCD table 402.

Figure 7:
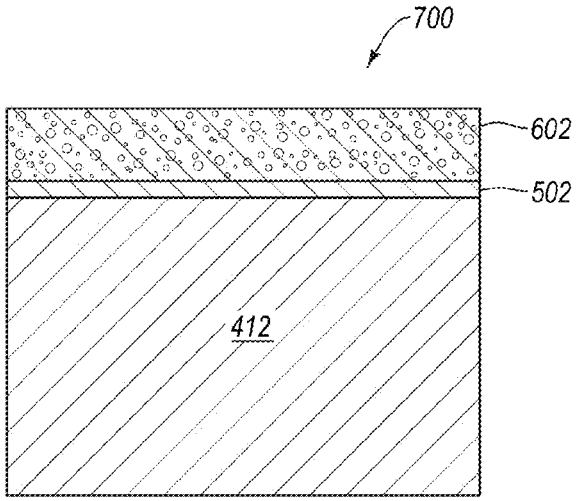
FIG. 7 is a cross-sectional view of an assembly to be HPHT processed to form the PDCs shown in FIGS. 4A and 4B according to another embodiment of method.

FIG. 7 is a cross-sectional view of an assembly 700 to be HPHT processed to form the PDCs 400 and 400' shown in FIGS. 4A and 4B according to another embodiment of method. In this embodiment, the aluminum-material layer 502 may be positioned between the at least partially leached PCD table 602 and the cemented carbide substrate 412 to form the assembly 700. The assembly 700 may be enclosed in a suitable pressure transmitting medium and subjected to an HPHT process to form the PDCs 400 and 400' shown in FIGS. 4A and 4B using the same or similar HPHT conditions previously discussed with respect to HPHT processing the assembly 300 shown in FIG. 3A.

Figure 8A:
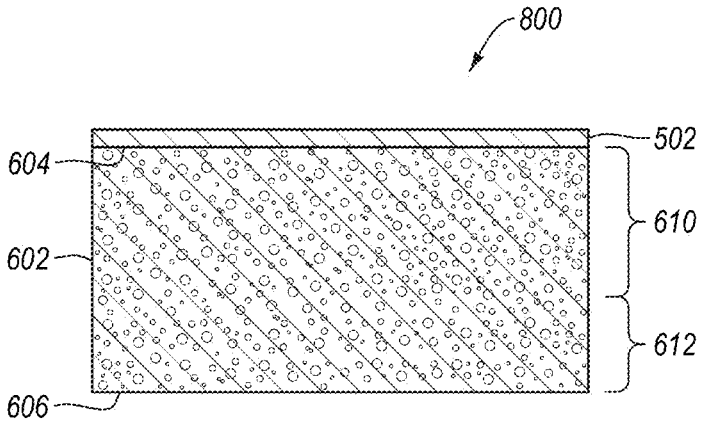
FIGS. 8A and 8B are cross-sectional views at different stages during another embodiment of a method for fabricating the PDC shown in FIG. 4B.
Figure 8B:
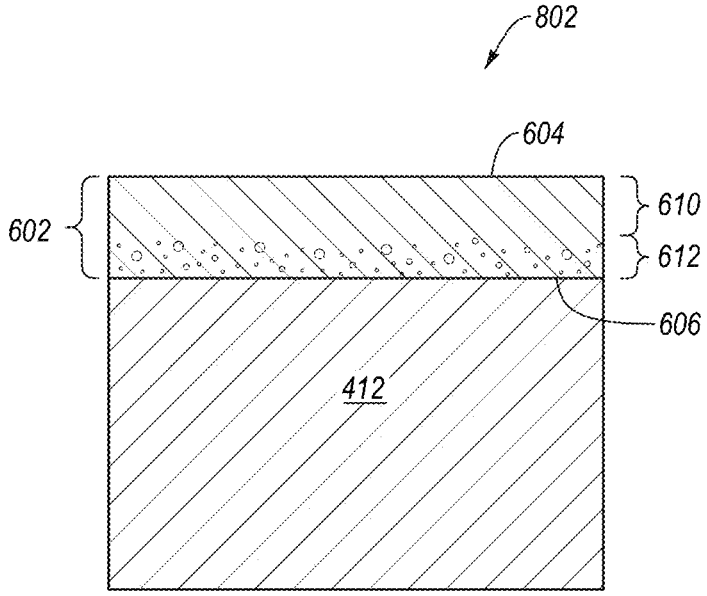

FIGS. 8A and 8B are cross-sectional views at different stages during another embodiment of a method for fabricating the PDC 400' shown in FIG. 4B. Referring to FIG. 8A, the at least partially leached PCD table 602 may be provided that includes the upper surface 604 and the back surface 606. The aluminum-material layer 502 may be positioned adjacent to the upper surface 604 to form the assembly 800, such as by coating the upper surface 604 with the aluminum-material layer 502 and/or disposing the aluminum-material layer 502 in the bottom of a container and placing the at least partially leached PCD table 602 in the container and in contact with the aluminum-material layer 502.

The assembly 800 may be enclosed in a suitable pressure transmitting medium to form a cell assembly and subjected to an HPHT process using the HPHT conditions used to HPHT process the assembly 300 shown in FIG. 3A. During the HPHT process, aluminum material from the aluminum-material layer 502 may partially or substantially completely melt and infiltrate into at least a portion of the interstitial regions of the first region 610 of the at least partially leached PCD table 602 to form a partially infiltrated PCD table 602' (FIG. 8B). The volume of the aluminum-material layer 502 may be selected so that it is sufficient to only fill the interstitial regions of the selected first region 610. Thus, the interstitial regions of the second region 612 are not infiltrated with the aluminum material and, thus, are substantially free of the aluminum material. During the HPHT process, the infiltrated aluminum material reacts with the diamond grains of the at least partially leached PCD table 602 and/or another carbon source in the first region 610 to form aluminum carbide that is disposed interstitially between the diamond grains thereof.

In another embodiment, when the aluminum material of the aluminum-material layer 502 melts or begins melting at a sufficiently low temperature so the infiltration can be performed without significantly damaging the diamond grains of the at least partially leached PCD table 602, the aluminum material may be infiltrated into the at least partially leached PCD table 602 under atmospheric pressure conditions, under vacuum or partial vacuum conditions, or in a hot pressing process (e.g., hot isostatic pressing "HIP"). For example, one suitable aluminum material may comprise a eutectic or near eutectic (e.g., hypereutectic or hypoeutectic) mixture or alloy of aluminum and silicon.

Referring to FIG. 8B, the back surface 606 of the partially infiltrated PCD table 602' may be positioned adjacent to the cemented carbide substrate 412 to form an assembly 802. The assembly 802 may be subjected to an HPHT process using the HPHT conditions used to HPHT process the assembly 300 shown in FIG. 3A. During the HPHT process, the metallic constituent present in the cemented carbide substrate 412 may liquefy, and infiltrate into and occupy at least a portion of the interstitial regions of the second region 612. Upon cooling from the HPHT process, the metallic constituent forms a strong metallurgical bond between the cemented carbide substrate 412 and the second region 612.

Figure 9A:
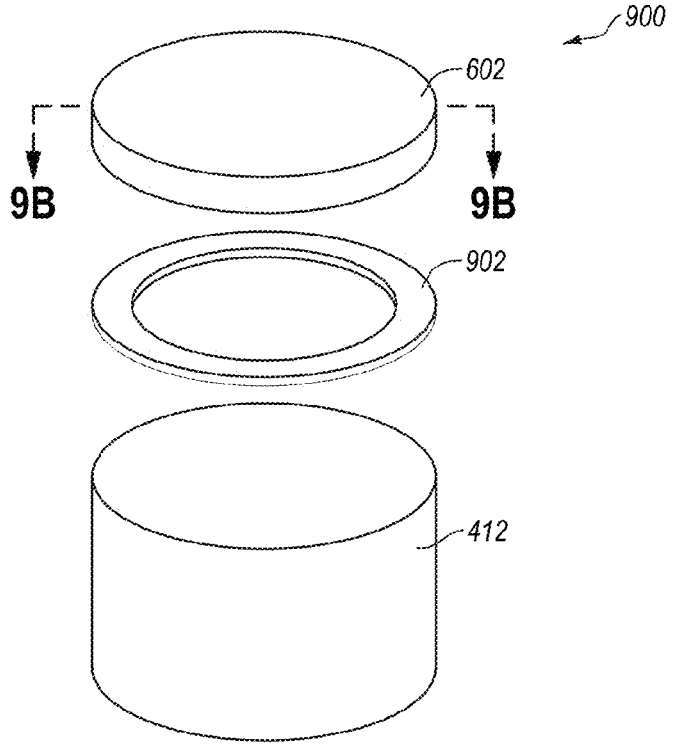
FIG. 9A is an exploded isometric view of an assembly to be HPHT processed to form a PDC including a PCD table having aluminum carbide disposed in selective locations according to an embodiment of method.
Figure 9B:
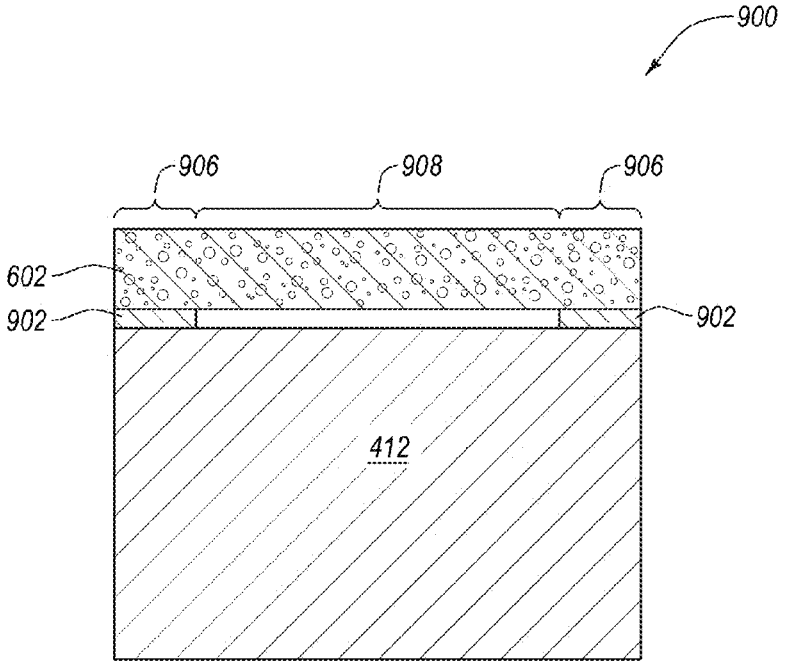
FIG. 9B is a cross-sectional view of the assembly shown in FIG. 9A taken along line 9B-9B.

In other embodiments, the at least partially leached PCD table 602 may be selectively infiltrated with the aluminum material to provide a thermally-stable cutting edge region while a metallic constituent may be infiltrated in other regions of the at least partially leached PCD table 602 to provide a strong bond with the cemented carbide substrate 412. FIGS. 9A and 9B are exploded isometric and cross-sectional views of an assembly 900 to be HPHT processed to form a PDC including a PCD table that is infiltrated with the aluminum material in selective locations according to an embodiment of method. The assembly 900 includes a thin ring 902 or other annular structure made from any of the aluminum materials disclosed herein and exhibiting any of the previously disclosed thicknesses disclosed for the aluminum-material layer 502. The thin ring 902 is disposed between the at least partially leached PCD table 602 and the cemented carbide substrate 412.

Figure 9C:
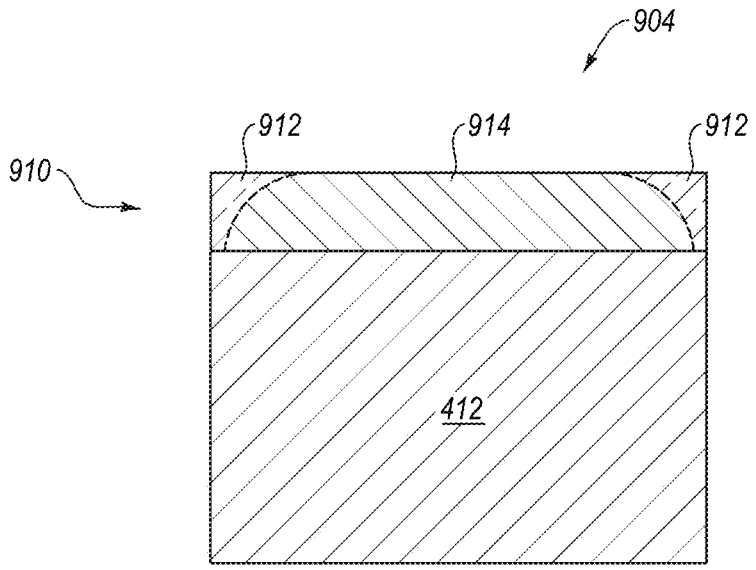
FIG. 9C is a cross-sectional view of the PDC formed by HPHT processing the assembly shown in FIGS. 9A and 9B.
Figure 9D:
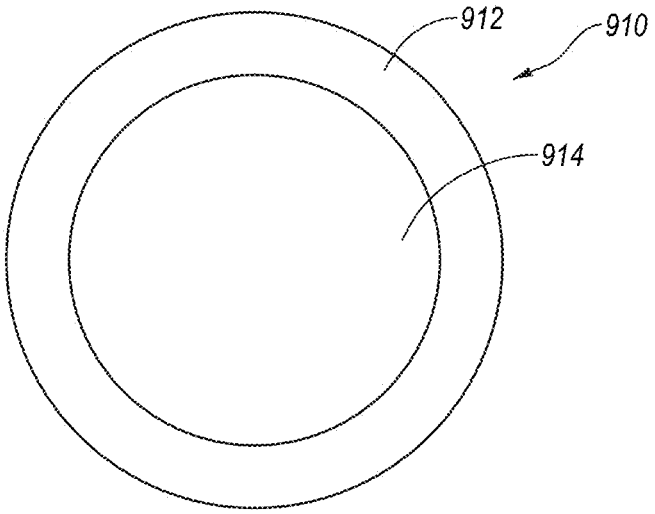
FIG. 9D is a top plan view of the infiltrated PCD table of the PDC shown in FIG. 9C.

FIGS. 9C and 9D are cross-sectional and top plan views, respectively, of a PDC 904 formed by HPHT processing the assembly 900. During the HPHT process, the thin ring 902 liquefies and infiltrates into a generally annular region 906 (FIG. 9B) of the at least partially leached PCD table 602. During the HPHT process, the infiltrated aluminum material from the ring 902 reacts with the diamond grains of the at least partially leached PCD table 602 and/or another carbon source to form aluminum carbide that is disposed interstitially between the diamond grains of the generally annular region 906. During the HPHT process, a metallic constituent (e.g., cobalt) from the cemented carbide substrate 412 also infiltrates into a core region 908 (FIG. 9B) of the at least partially leached PCD table 602. In some embodiments, the thin ring 902 liquefies before the metallic constituent and, thus, the metallic constituent infiltrates the core region 908 after the aluminum material infiltrates into the generally annular region 906. However, in other embodiments, the metallic constituent may infiltrate at substantially the same time as the aluminum material. The infiltrated metallic constituent provides a strong metallurgical bond between a PCD table 910 so-formed and the cemented carbide substrate 412. The PCD table 910 so-formed includes a thermally-stable cutting region 912 exhibiting a generally annular configuration that includes aluminum carbide disposed interstitially between the diamond grains and a core region 914 that includes the infiltrated metallic constituent from the cemented carbide substrate 412.

Figure 9E:
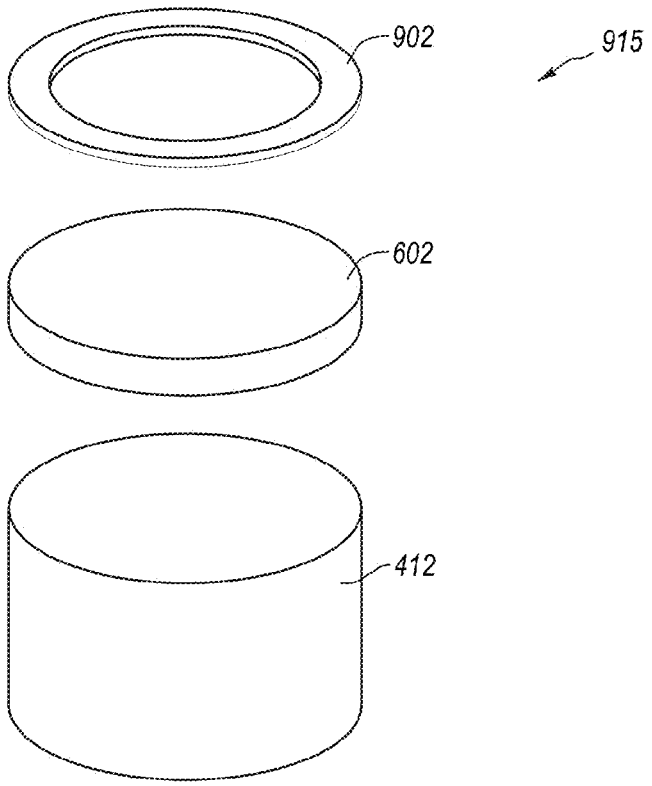
FIG. 9E is an exploded isometric view of an assembly to be HPHT processed to form a PDC, which is similar to the assembly shown in FIG. 9A, but the at least partially leached PCD table is disposed between the thin ring of the aluminum material and the cemented carbide substrate according to another embodiment of method.

In another embodiment shown in FIG. 9E, the at least partially leached PCD table 602 may be disposed between the thin ring 902 and the cemented carbide substrate 412 to form an assembly 915. The assembly 915 shown in FIG. 9E may be subjected to an HPHT process using the same or similar HPHT conditions used to process the assembly 300 shown in FIG. 3A.

Figure 9F:
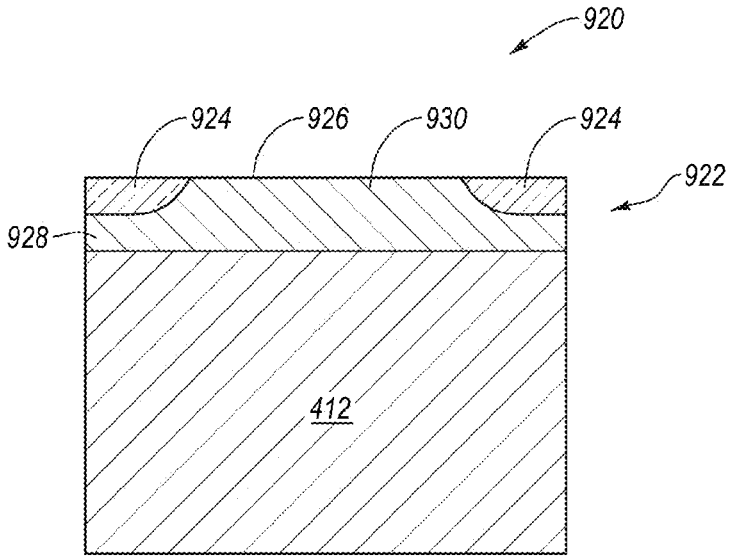
FIG. 9F is a cross-sectional view of the PDC formed by HPHT processing the assembly shown in FIG. 9E.

FIG. 9F is a cross-sectional view of a PDC 920 formed by HPHT processing the assembly shown in FIG. 9E. The PDC 920 includes a PCD table 922 bonded to the cemented carbide substrate 412. The PCD table 922 includes an upper surface 926 and at least one lateral surface 928. The PCD table 922 includes a generally annular thermally-stable region 924 that extends inwardly from and along only part of the upper surface 926 and the at least one lateral surface 928. The PCD table 920 also includes a core region 930 that includes an infiltrated metallic constituent from the cemented carbide substrate 412, which bonds the cemented carbide substrate 412 to the PCD table 922. The thermally-stable region 924 includes aluminum carbide disposed interstitially between diamond grains, which is formed from the infiltrated aluminum material provided from the thin ring 902 reacting with the diamond grains and/or another carbon source.

Figure 10A:
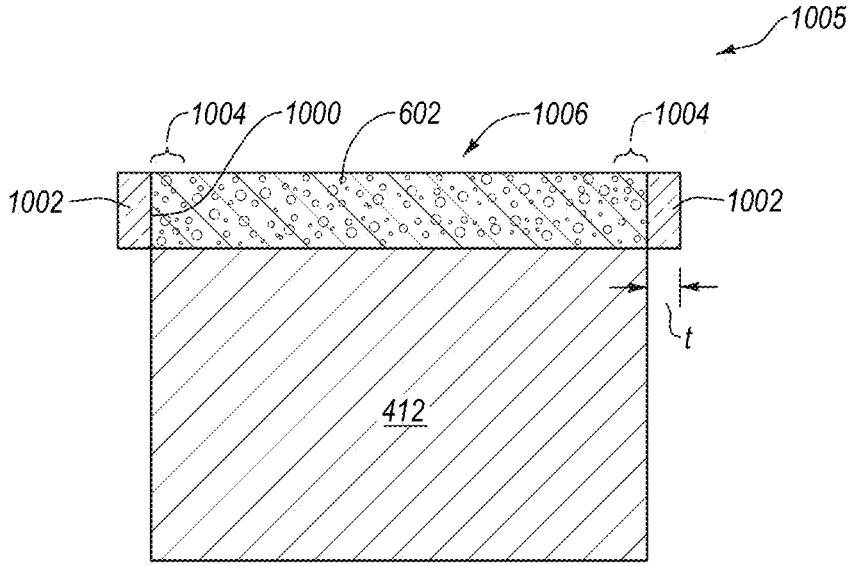
FIG. 10A is a cross-sectional view of an assembly to be HPHT processed to form a PDC including a PCD table that is partially infiltrated from a side thereof with aluminum material according to another embodiment of method.

Referring to FIG. 10A, in other embodiments, the at least partially leached PCD table 602 may be infiltrated with aluminum material from at least one lateral surface 1000 thereof. In such an embodiment, a ring 1002 may be disposed about the at least partially leached PCD table 602, and the assembly of the ring 1002 and the at least partially leached PCD table 602 may be positioned adjacent to the interfacial surface of the cemented carbide substrate 412 to form an assembly 1005. The ring 1002 may be made from any of the aluminum materials disclosed herein and may exhibit any of the previously disclosed thicknesses "t" disclosed for the aluminum-material layer 502. The assembly 1005 may be subjected to an HPHT process using the same or similar HPHT conditions used to process the assembly 300 shown in FIG. 3A.

During the HPHT process, the ring 1002 liquefies and infiltrates through the at least one lateral surface 1000 and into a generally annular region 1004 of the at least partially leached PCD table 602. The infiltrated aluminum material from the ring 1002 reacts with the diamond grains of the at least partially leached PCD table 602 and/or another carbon source to form aluminum carbide that is disposed interstitially between the diamond grains of the generally annular region 1004. During the HPHT process, a metallic constituent from the cemented carbide substrate 412 also infiltrates into a core region 1006 of the at least partially leached PCD table 602. In some embodiments, the ring 1002 liquefies before the metallic constituent and, thus, the metallic constituent infiltrates the core region 1006 after the aluminum material infiltrates into the generally annular region 1004. However, in other embodiments, the metallic constituent may infiltrate at substantially the same time as the aluminum material.

Figure 10B:
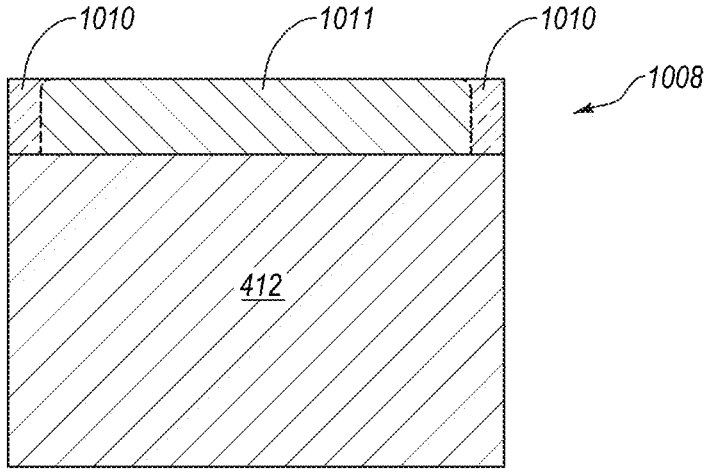
FIG. 10B is a cross-sectional view of the PDC formed by HPHT processing the assembly shown in FIG. 10A.

Referring to FIG. 10B, the infiltrated metallic constituent provides a strong metallurgical bond between a PCD table 1008 so-formed and the cemented carbide substrate 412. The PCD table 1008 so-formed includes a thermally-stable cutting region 1010 exhibiting a generally annular configuration that includes aluminum carbide formed from the infiltrated aluminum material provided from the ring 1002 that reacts with the at least partially leached PCD table 602 and/or another carbon source, and a core region 1011 including the infiltrated metallic constituent.

Figure 10C:
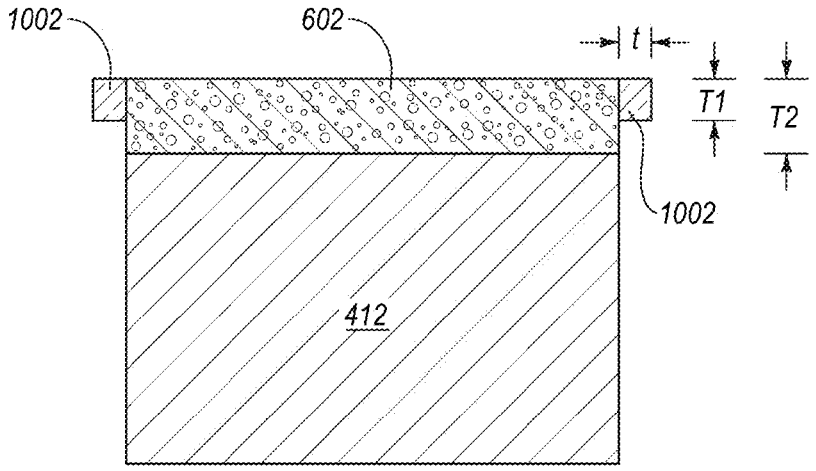
FIG. 10C is a cross-sectional view of an assembly to be HPHT processed to form a PDC including a PCD table that is partially infiltrated from the side with aluminum material according to yet another embodiment of method.
Figure 10D:
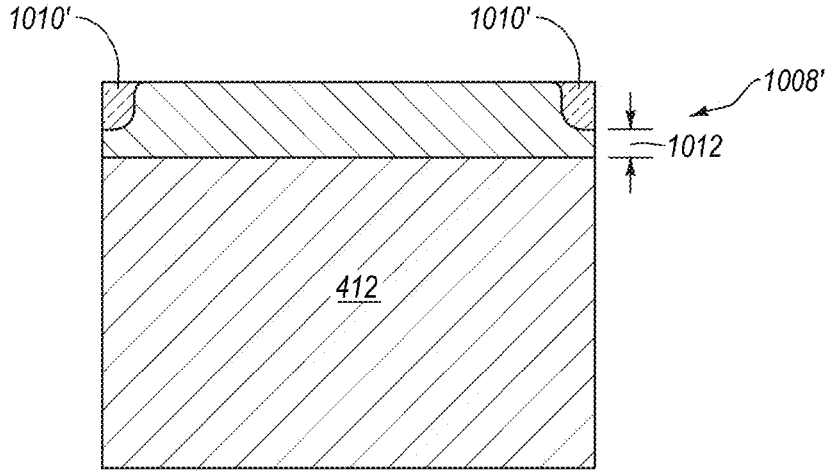
FIG. 10D is a cross-sectional view of the PDC formed by HPHT processing the assembly shown in FIG. 10C.

Referring to FIG. 10C, in some embodiments, the ring 1002 may exhibit a thickness T1 that is dimensioned to be less than that of a thickness T2 of the at least partially leached PCD table 602. Referring to FIG. 10D, after HPHT process of the assembly shown in FIG. 10C, a PCD table 1008' so-formed includes a thermally-stable cutting region 1010' that does not extend the total thickness T2 of the PCD table 1008'. Rather, the thermally-stable cutting region 1010' only extends part of the thickness of the PCD table 1008' and has a standoff 1012 from the interfacial surface of the cemented carbide substrate 412.

Figure 10E:
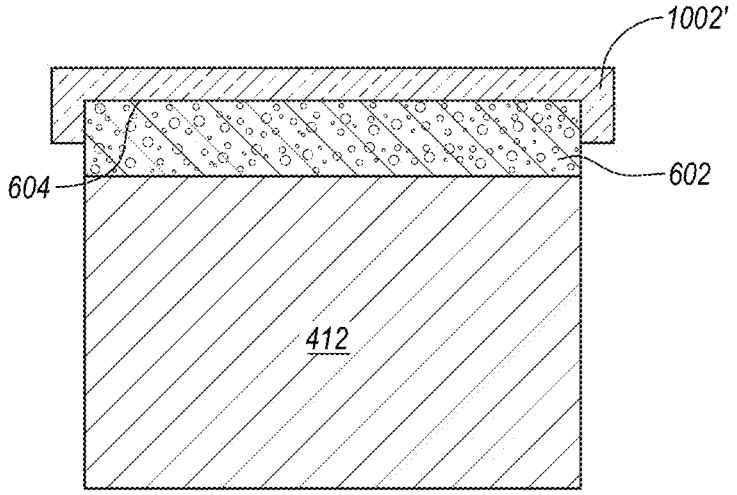
FIG. 10E is a cross-sectional view of an assembly to be HPHT processed to form a PDC including a PCD table with a cap-like structure including aluminum carbide therein according to an embodiment.
Figure 10F:
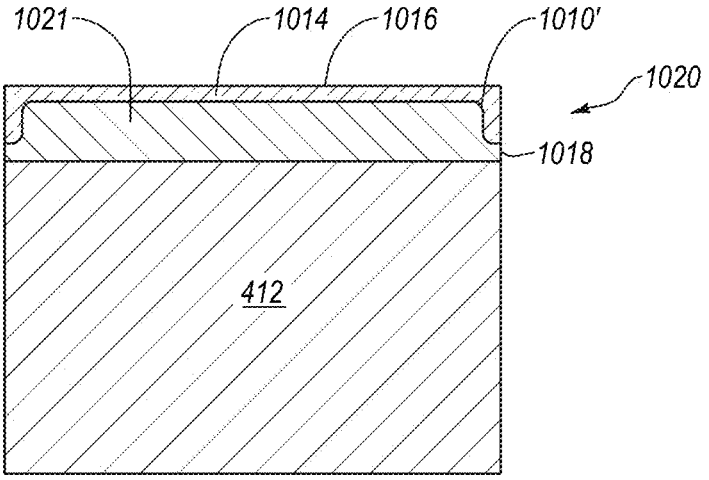
FIG. 10F is a cross-sectional view of the PDC formed by HPHT processing the assembly shown in FIG. 10E.

In other embodiments, a cap-like structure including aluminum carbide may be formed. Referring to FIG. 10E, a receptacle 1002' made from the aluminum material may be placed over the upper surface 604 of the at least partially leached PCD table 602. As shown in FIG. 10F, after HPHT processing, the aluminum material infiltrates the at least partially leached PCD table 602 to form a cap-like structure 1014 that extends along an upper surface 1016 and lateral surface 1018 of infiltrated PCD table 1020 so-formed. A metallic constituent from the cemented carbide substrate 412 also infiltrates into the at least partially leached PCD table 602 to form a region 1021 that bonds to the cemented carbide substrate 412. The cap-like structure 1014 includes aluminum carbide disposed interstitially between the bonded-together diamond grains of PCD table 1020 formed from the infiltrated aluminum material reacting with the bonded-together diamond grains and/or another carbon source. Depending upon the geometry of the receptacle 1002', the cap-like structure 1014 may extend along only part of the length of the lateral surface 1018 or along substantially the entire length of the lateral surface 1018 so that there is no standoff from the interfacial surface of the cemented carbide substrate 412 to which the infiltrated PCD table 1020 is bonded.

Figure 11A:
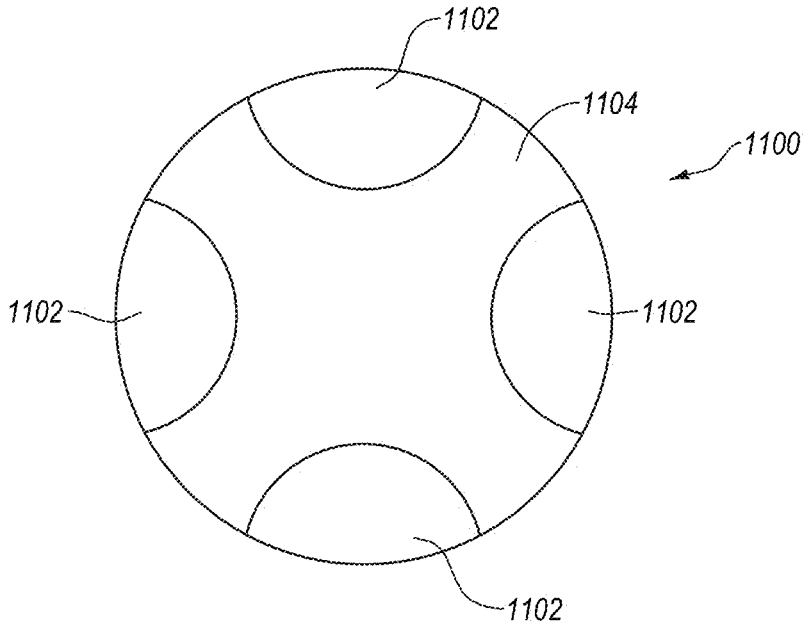
FIG. 11A is a top plan view of an infiltrated PCD table of a PDC that is selectively infiltrated with the aluminum material in a plurality of discrete locations according to an embodiment.

A variety of other thermally-stable cutting region configurations may be formed besides those illustrated in FIGS. 9C, 10B, and 10D. FIG. 11A is a top plan view of a PCD table 1100 that is selectively infiltrated with aluminum material in multiple discrete locations to form a plurality of thermally-stable cutting regions 1102 with aluminum carbide disposed interstitially between the bonded-together diamond grains thereof according to another embodiment. A main region 1104 may be infiltrated with a metallic constituent from the cemented carbide substrate 412 (not shown). The plurality of thermally-stable cutting regions 1102 may be formed, for example, by dividing the thin ring 902 (FIGS. 9A and 9B) into discrete sections that are placed between the at least partially leached PCD table 602 and the cemented carbide substrate 412 and circumferentially spaced from each other. In other embodiments, the discrete sections may be placed adjacent to an upper surface of the at least partially leached PCD table 602.

Figure 11B:
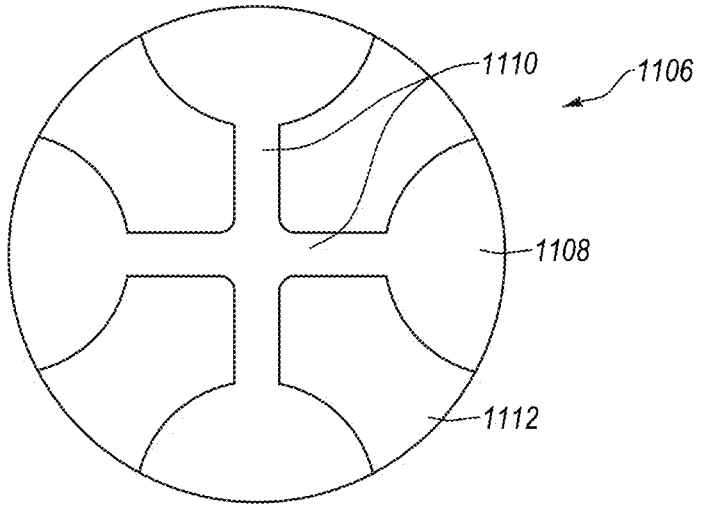
FIG. 11B is a top plan view of an infiltrated PCD table of a PDC that is selectively infiltrated with the aluminum material in a plurality of discrete locations according to another embodiment.

FIG. 11B is a top plan view of an infiltrated PCD table 1106 that is selectively infiltrated with the aluminum material in multiple discrete locations to form a plurality of thermally-stable cutting regions 1108 with aluminum carbide disposed interstitially between the bonded-together diamond grains thereof according to another embodiment. The plurality of thermally-stable cutting regions 1108 are interconnected by a network of radially-extending branches 1110. A region 1112 extending about the plurality of thermally-stable cutting regions 1108 and the branches 1110 may be infiltrated with a metallic constituent from the cemented carbide substrate 412 (not shown). The plurality of thermally-stable cutting regions 1108 and the branches 1110 may be formed by cutting, stamping, or machining a substantially correspondingly shaped structure from a thin disc made from the aluminum material.

With reference to the above embodiments that infiltrate the at least partially leached PCD table 602, it should be noted that the thickness of the at least partially leached PCD table 602 may be reduced after HPHT processing. Before and/or after infiltration, the at least partially leached PCD table 602 may be subjected to one or more types of finishing operations, such as grinding, machining, or combinations of the foregoing. For example, the at least partially leached PCD table 602 may be chamfered prior to or after being infiltrated with the aluminum material.

Although the at least partially leached PCD table 602 is typically attached to a cemented carbide substrate, in other embodiments, the PDCs 100 and 100' may be formed by forming an assembly including the at least partially leached PCD table 602 positioned adjacent to the aluminum-based substrate 112. The assembly so-formed may be subjected to an HPHT process to infiltrate the pores of the at least partially leached PCD table 602 with aluminum material from the aluminum-based substrate 112 to form the PCD table 102 (FIG. 1A) that bonds to the aluminum-based substrate 112 upon cooling.

Figure 12:
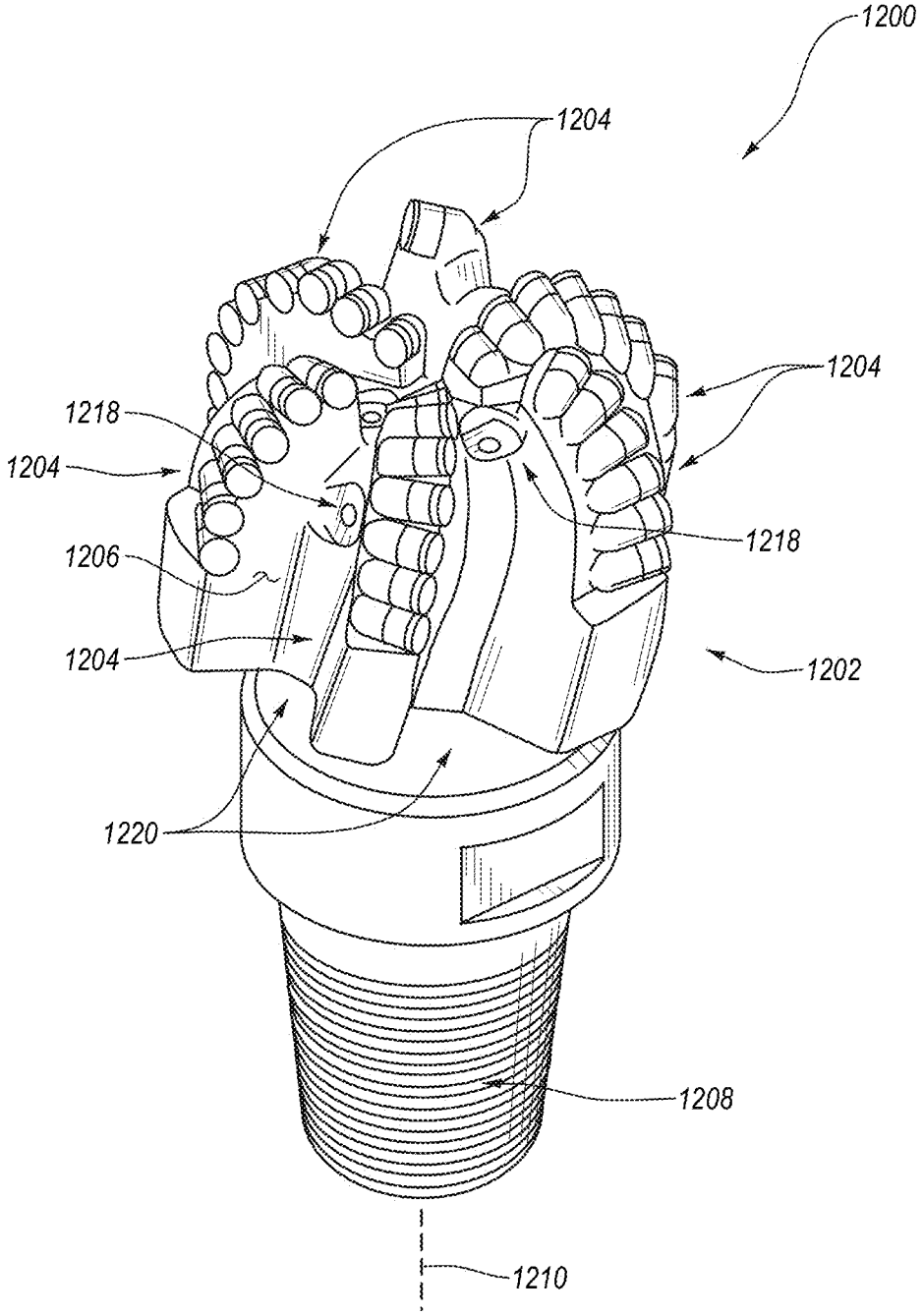
FIG. 12 is an isometric view of an embodiment of a rotary drill bit that may employ one or more of the disclosed PDC embodiments.
Figure 13:
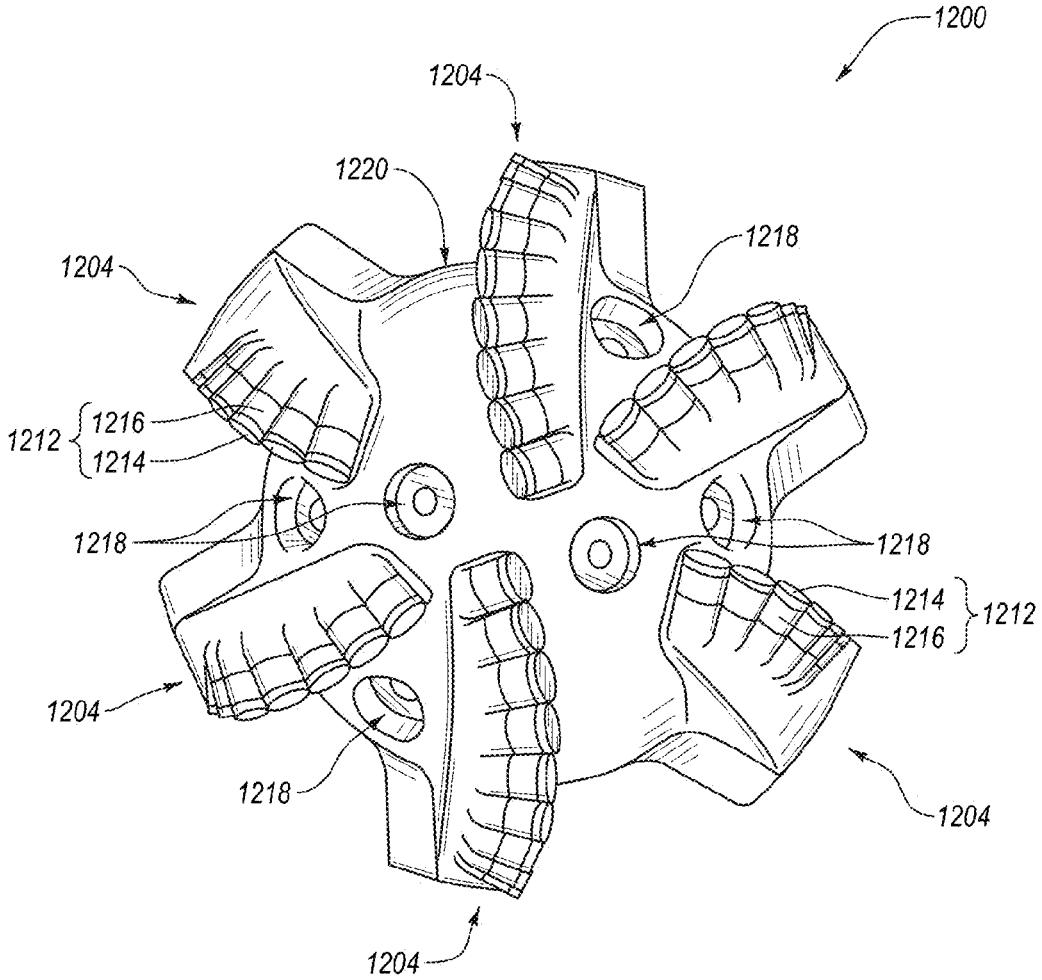
FIG. 13 is a top elevation view of the rotary drill bit shown in FIG. 12.

FIG. 12 is an isometric view and FIG. 13 is a top elevation view of an embodiment of a rotary drill bit 1200 that includes at least one PDC configured and/or made according to any of the disclosed PDC embodiments. The rotary drill bit 1200 includes a bit body 1202 that includes radially and longitudinally extending blades 1204 having leading faces 1206, and a threaded pin connection 1208 for connecting the bit body 1202 to a drilling string. The bit body 1202 defines a leading end structure for drilling into a subterranean formation by rotation about a longitudinal axis 1210 and application of weight-on-bit. At least one PDC, configured and/or made according to any of the disclosed PDC embodiments, may be affixed to the bit body 1202. With reference to FIG. 12, each of a plurality of PDCs 1212 is secured to the blades 1204 of the bit body 1202 (FIG. 13). For example, each PDC 1212 may include a PCD table 1214 bonded to a substrate 1216. More generally, the PDCs 1212 may comprise any PDC disclosed herein, without limitation. In addition, if desired, in some embodiments, a number of the PDCs 1212 may be conventional in construction. Also, circumferentially adjacent blades 1204 define so-called junk slots 1220 therebetween. Additionally, the rotary drill bit 1200 includes a plurality of nozzle cavities 1218 for communicating drilling fluid from the interior of the rotary drill bit 1200 to the PDCs 1212.

FIGS. 12 and 13 merely depict one embodiment of a rotary drill bit that employs at least one PDC fabricated and structured in accordance with the disclosed embodiments, without limitation. The rotary drill bit 1200 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., PDC 100 of FIG. 1) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIG. 1) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

The following working examples set forth various formulations and methods for forming PDCs. In the following working examples, the wear resistance and thermal stability of Working Examples 1-5 of the invention are compared to the wear resistance and thermal stability of conventional Comparative Examples 1 and 2.

Working Example 1

PDCs were formed according to the following process. A PCD table was formed by HPHT sintering in a high-pressure cubic press at a temperature of about 1400° C. and a pressure of about 6.5 GPa (cell pressure), in the presence of cobalt, diamond particles having an average grain size of about 19 μm. The PCD table included bonded diamond grains, with cobalt disposed within interstitial regions between the bonded diamond grains. The PCD table was leached with acid for a time sufficient to remove substantially all of the cobalt from the interstitial regions to form an at least partially leached PCD table. An assembly was formed having a configuration similar to the assembly 600 shown in FIG. 6 including the at least partially leached PCD table disposed between a cobalt-cemented tungsten carbide substrate and a disc of aluminum having a thickness of about 0.0010 inch (25.4 μm). The at least partially leached PCD table, cobalt-cemented tungsten carbide substrate, and disc of aluminum were placed in a container assembly and HPHT processed in a high-pressure cubic press at a temperature of about 1400° C. and a pressure of about 5 GPa to about 6.5 GPa (cell pressure) to form a PDC comprising an infiltrated PCD table bonded to the cobalt-cemented tungsten carbide substrate. During the HPHT process, aluminum from the layer of aluminum infiltrated an upper region of the PCD table and cobalt from the cobalt-cemented tungsten carbide substrate infiltrated a lower region of the PCD table adjacent the cobalt-cemented tungsten carbide substrate.

Figure 14:
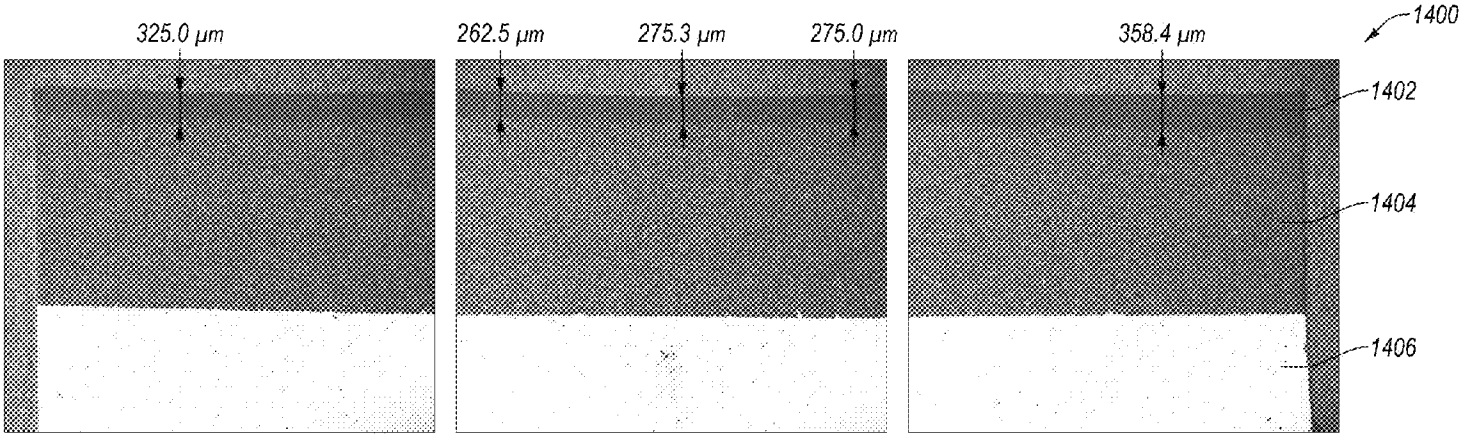
FIGS. 14-18 are scanning electron photomicrographs of PDCs formed according to Working Examples 1-5 of the invention, respectively.

FIG. 14 is a scanning electron photomicrograph of one of the PDC so-formed in Working Example 1 clearly showing the PCD table 1400 including the aluminum-infiltrated region 1402 and the cobalt-infiltrated region 1404 bonded to the cobalt-cemented tungsten carbide substrate 1406. The thickness of the region 1402 that includes aluminum carbide disposed interstitially within the infiltrated PCD table is indicated at various locations in the photomicrograph of FIG. 14.

Working Example 2

Figure 15:
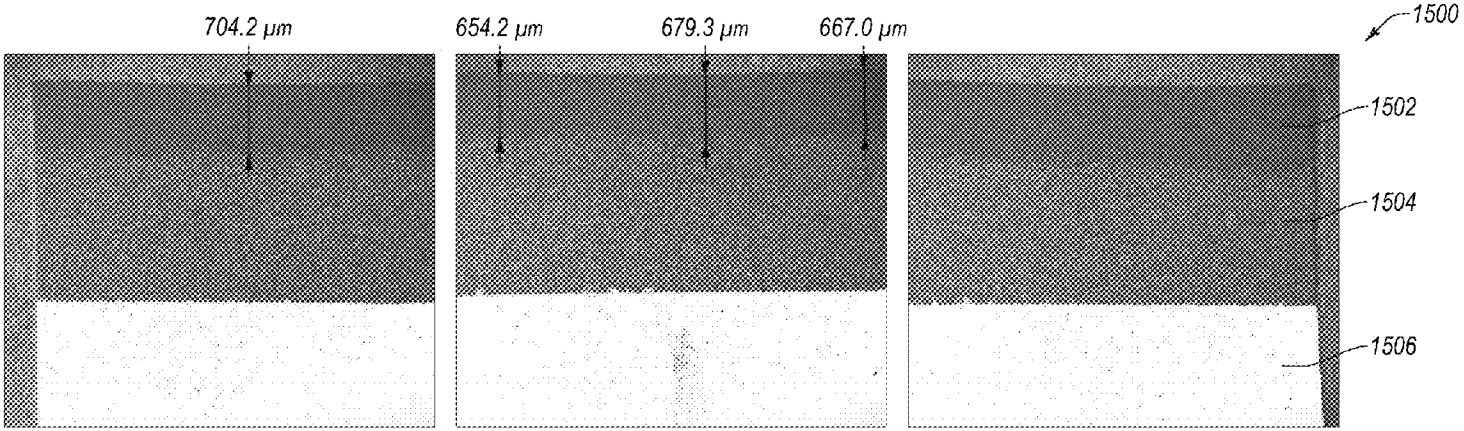

PDCs were formed according to the same process as the PDC in Working Example 1 except the thickness of the disc of aluminum was about 0.0020 inch (50.8 μm). FIG. 15 is a scanning electron photomicrograph of one of the PDCs so-formed in Working Example 2 clearly showing an infiltrated PCD table 1500 including an aluminum-infiltrated region 1502 and a cobalt-infiltrated region 1504 bonded to a cobalt-cemented tungsten carbide substrate 1506. The thickness of the aluminum-infiltrated region 1502 that includes aluminum carbide disposed interstitially within the infiltrated PCD table was greater than that of the aluminum-infiltrated region 1402 of Working Example 1. The thickness of the aluminum-infiltrated region 1502 is indicated at various locations in the photomicrograph of FIG. 15.

Working Example 3

Figure 16:
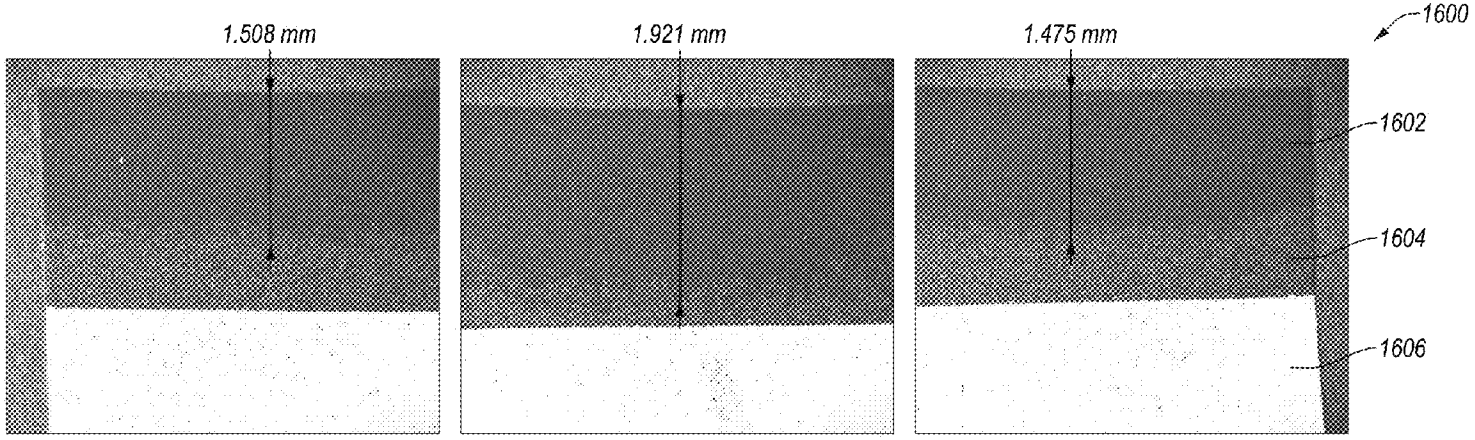
Figure 21:
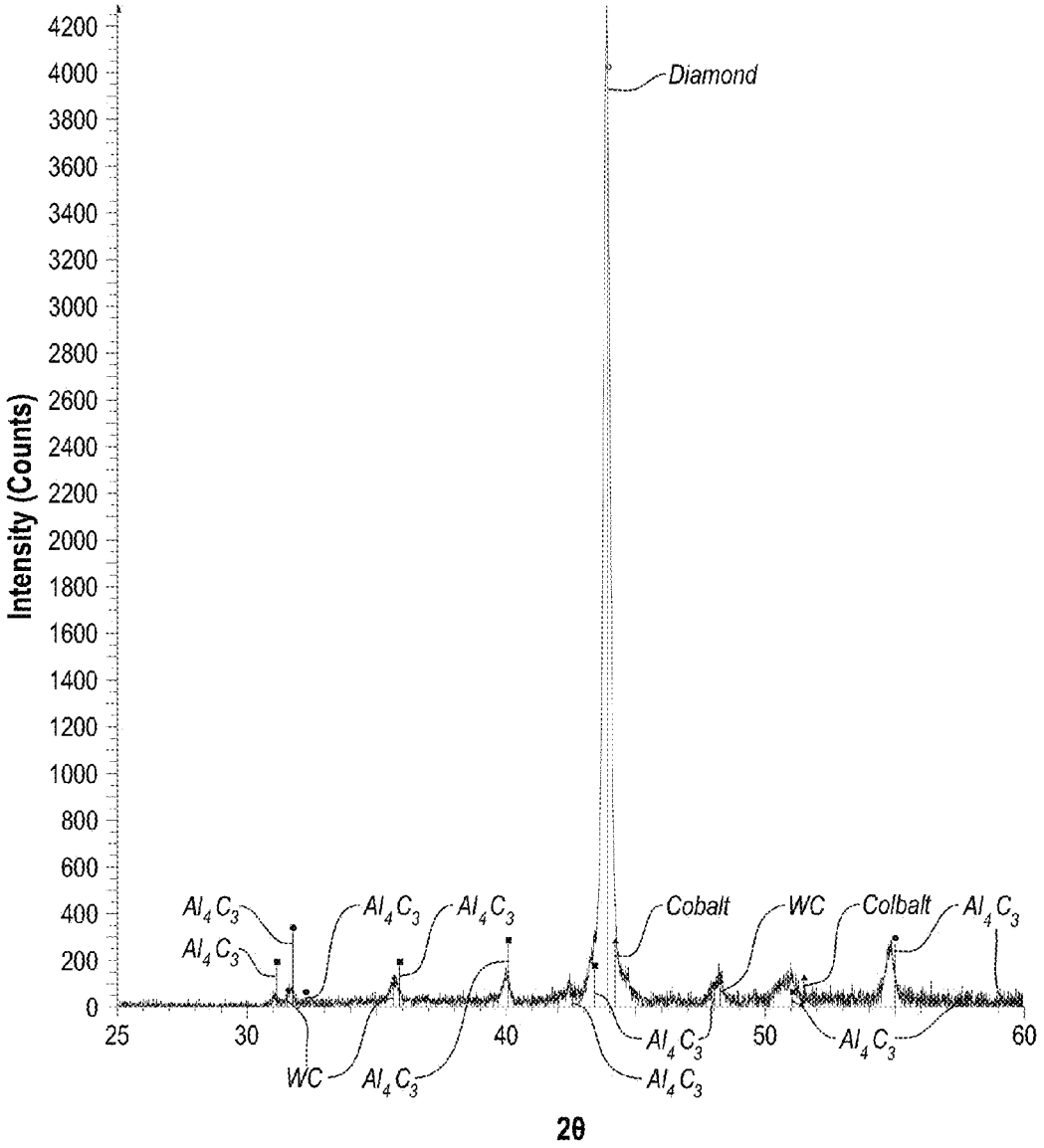
FIG. 21 is an x-ray diffraction spectrum obtained by performing x-ray diffraction on the infiltrated PCD table of one of the PDCs of Working Example 3.

PDCs were formed according to the same process as the PDC in Working Example 1 except the thickness of the disc of aluminum was about 0.0030 inch (76.2 μm). FIG. 16 is a scanning electron photomicrograph of the PDC so-formed in Working Example 3 clearly showing an infiltrated PCD table 1600 including an aluminum-infiltrated region 1602 and a cobalt-infiltrated region 1604 bonded to a cobalt-cemented tungsten carbide substrate 1606. The thickness of the aluminum-infiltrated region 1602 that includes aluminum carbide disposed interstitially within the infiltrated PCD table was greater than that of the aluminum-infiltrated region 1602 of Working Example 1. The thickness of the aluminum-infiltrated region 1602 is indicated at various locations in FIG. 16. FIG. 21 is an x-ray diffraction spectrum from x-ray diffraction testing performed on the infiltrated PCD table of one of the PDCs so formed. The x-ray diffraction testing showed that the infiltrated PCD table included aluminum carbide ($Al_4C_3$), diamond, cobalt, and tungsten carbide (WC). The standard peaks for aluminum carbide, diamond, cobalt, and tungsten carbide are labeled and superimposed on the x-ray diffraction spectrum shown in the photomicrograph of FIG. 21.

Working Example 4

Figure 17:
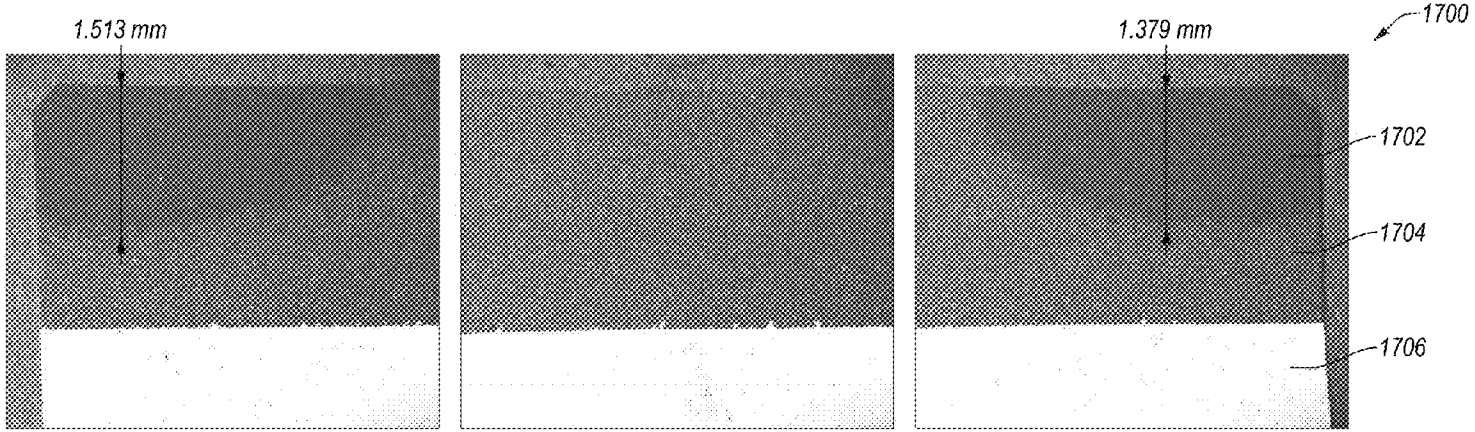

PDCs were formed according to the same process as the PDC in Working Example 1 except the thickness of the disc of aluminum was about 0.0030 inch (76.2 μm) and the disc exhibited a ring-like geometry similar to that shown in assembly 915 of FIG. 9E. FIG. 17 is a scanning electron photomicrograph of one of the PDCs so-formed in Working Example 3 clearly showing an infiltrated PCD table 1700 including an aluminum-infiltrated region 1702 and a cobalt-infiltrated region 1704 bonded to a cobalt-cemented tungsten carbide substrate 1706. As shown in FIG. 17, due to the ring-like geometry of the disc of aluminum, the aluminum selectively infiltrated the at least partially leached PCD table to form a generally annular thermally-stable region. The thickness of the aluminum-infiltrated region 1702 that includes aluminum carbide disposed interstitially within the infiltrated PCD table is indicated at various locations in the photomicrograph of FIG. 17.

Working Example 5

Figure 18:
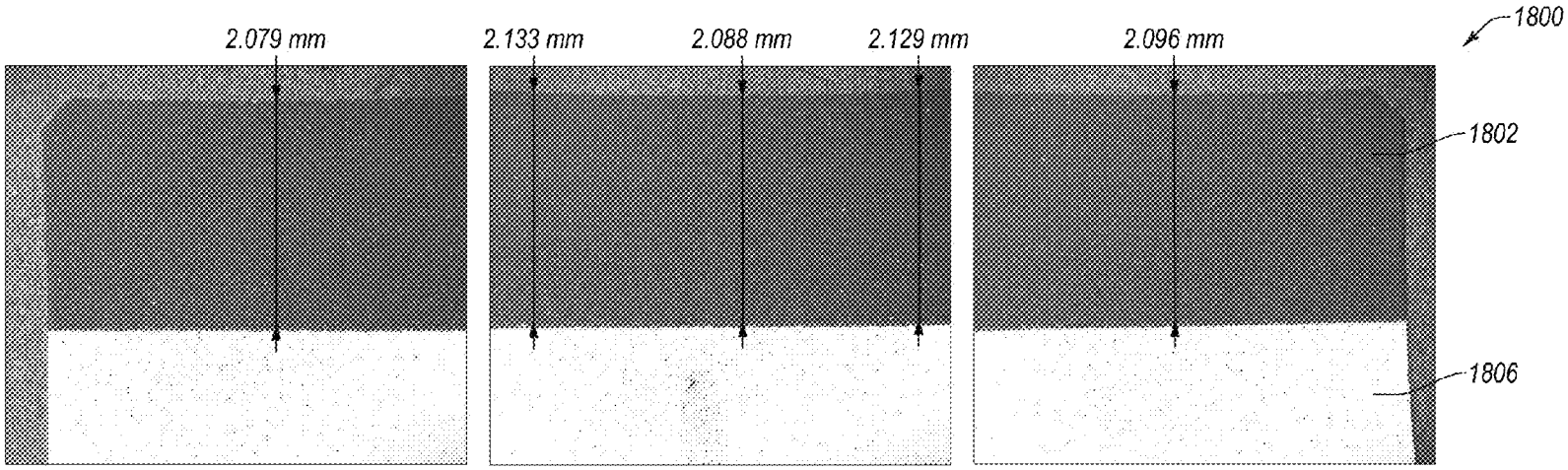

PDCs were formed according to the same process as the PDC in Working Example 4 except the thickness of the disc of aluminum was about 0.0040 inch (101.6 μm). FIG. 18 is a scanning electron photomicrograph of one of the PDCs so-formed in Working Example 5 clearly showing the infiltrated PCD table 1800 including the aluminum-infiltrated region 1802 bonded to the cobalt-cemented tungsten carbide substrate 1806. As shown in FIG. 18, the aluminum-infiltrated region comprises substantially all of the infiltrated PCD table 1800. However, although the photomicrograph in FIG. 18 does not illustrate a cobalt-infiltrated region, cobalt infiltration from the cobalt-cemented tungsten carbide substrate 1806 did actually occur within a small portion of the PCD table. The thickness of the aluminum-infiltrated region 1802 that includes aluminum carbide disposed interstitially within the infiltrated PCD table is indicated at various locations in the photomicrograph of FIG. 18.

Comparative Example 1

Conventional PDCs were obtained that were fabricated by placing a layer of diamond particles having an average particle size of about 19 μm adjacent to a cobalt-cemented tungsten carbide substrate. The layer and substrate were placed in a container assembly. The container assembly, including the layer and substrate therein, was subjected to HPHT conditions in an HPHT press at a temperature of about 1400° C. and a pressure of about 7.8 GPa (cell pressure) to form a conventional PDC including a PCD table integrally formed and bonded to the cobalt-cemented tungsten carbide substrate. Cobalt was infiltrated into the layer of diamond particles from the cobalt-cemented tungsten carbide substrate catalyzing formation of the PCD table.

Comparative Example 2

PDCs were obtained, which was fabricated as performed in comparative example 1 except the HPHT processing pressure was about 5 GPa to about 6.5 GPa. After formation of the PDC, the PCD table was acid leached after machining to a depth of about 250 μm.

Wear Resistance and Thermal Stability Comparative Test Data

The wear resistance and thermal stability of the PCD tables of working examples 1-5 of the invention and comparative examples 1 and 2 were evaluated. The wear resistance was evaluated by measuring the volume of PDC removed versus the volume of Barre granite workpiece removed after fifty (50) passes, while the workpiece was cooled with water. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

The thermal stability was evaluated by measuring the distance cut in a Barre granite workpiece prior to failure, without using coolant, in a vertical turret lathe test. The distance cut is considered representative of the thermal stability of the PCD table. The test parameters were a depth of cut for the PDC of about 1.27 mm, a back rake angle for the PDC of about 20 degrees, an in-feed for the PDC of about 1.524 mm/rev, a cutting speed of the workpiece to be cut of about 1.78 msec, and the workpiece had an outer diameter of about 914 mm and an inner diameter of about 254 mm. All of the PDCs of Comparative Examples 1 and 2 were tested to failure in the thermal stability tests. Only some of Working Examples 1 were tested to failure in the thermal stability tests, which were the PDCs that failed at below 12,000 feet. All of the other PDCs of the Working Examples 1-5 of the invention were not tested to failure because the thermal stability tests were stopped shortly after the 12,000 feet distance was exceed.

Figure 19:
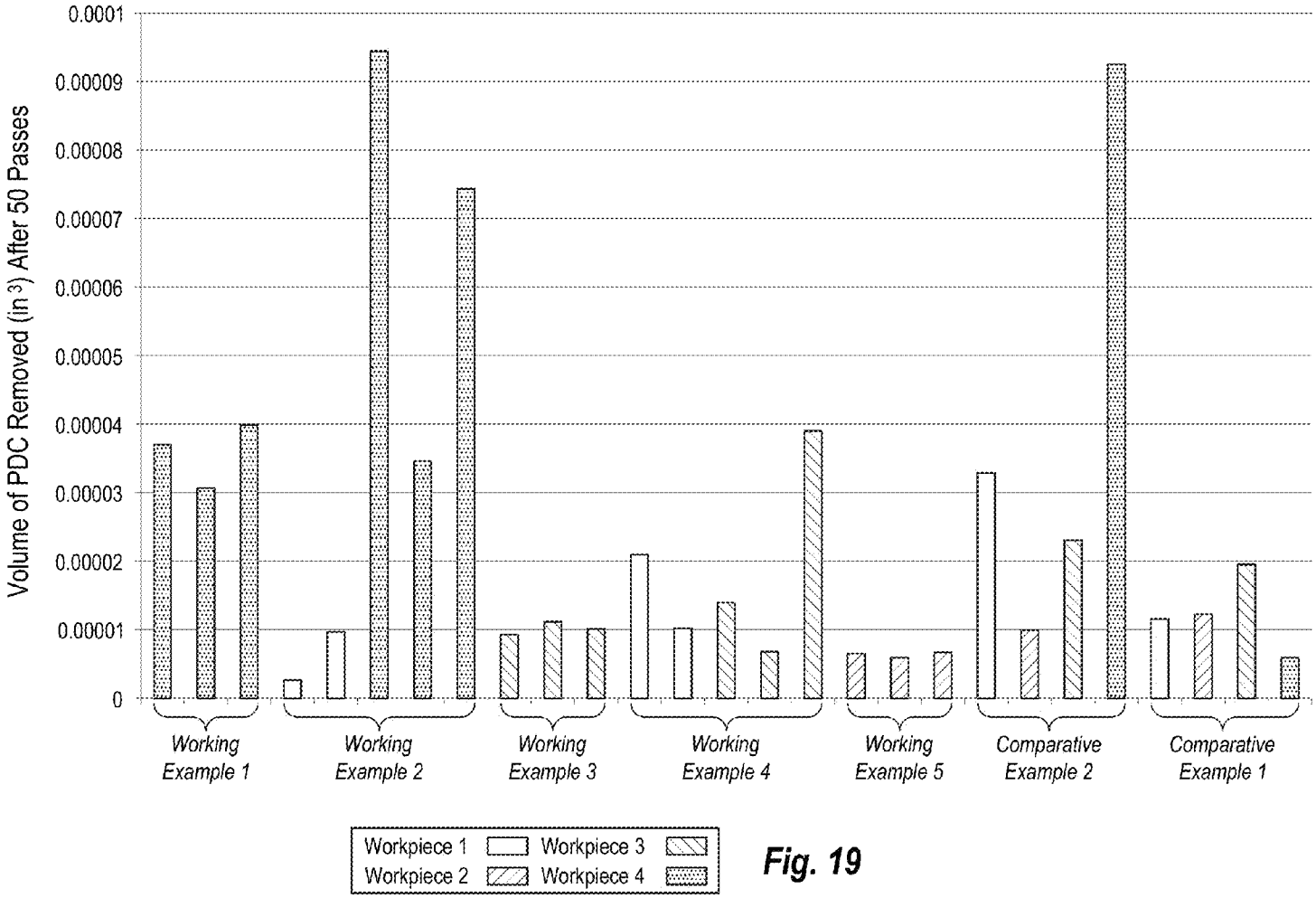
FIG. 19 is a bar chart that shows the wear resistance test results for the PDC of Working Examples 1-5 of the invention and Comparative Examples 1 and 2.
Figure 20:
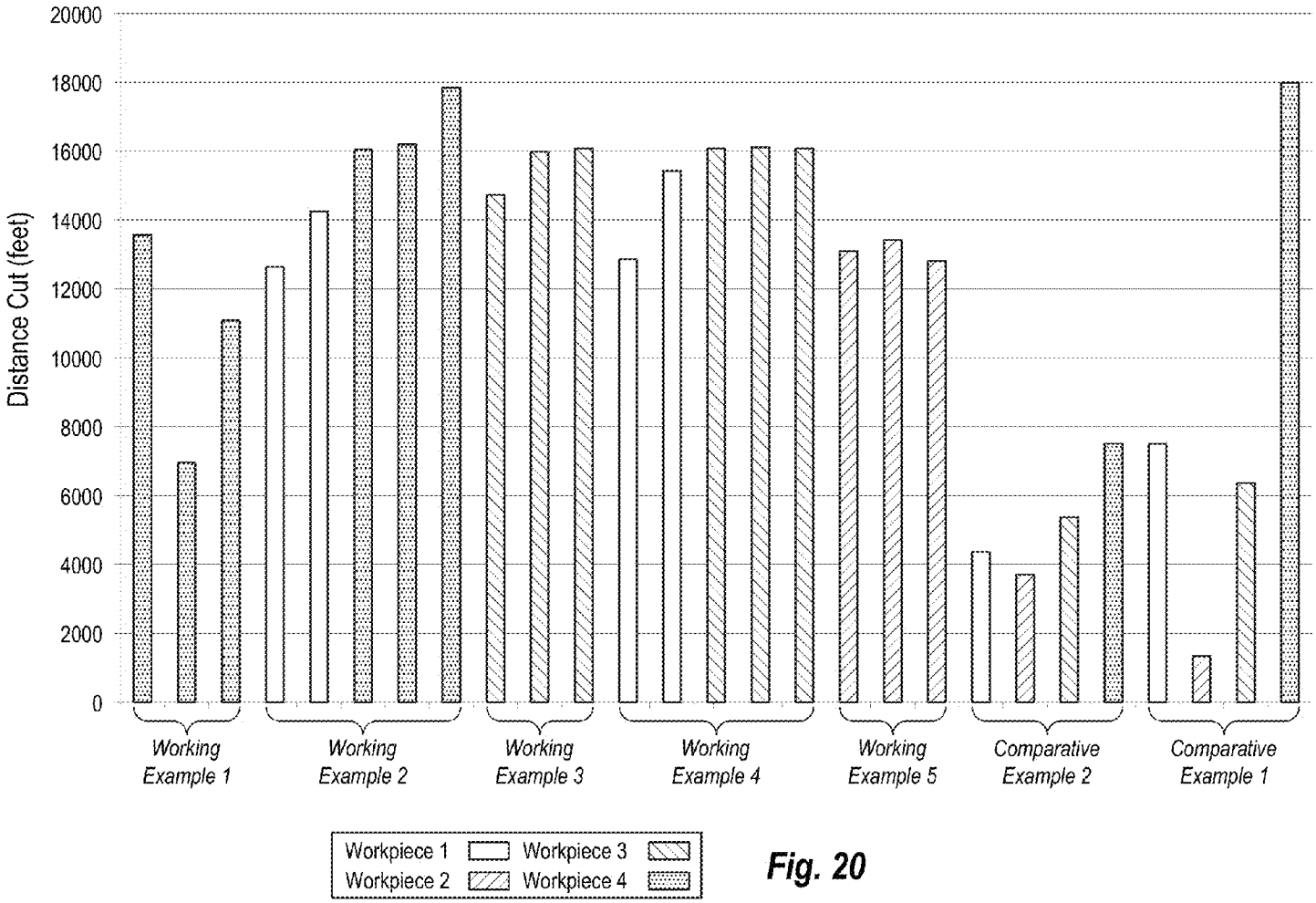
FIG. 20 is a bar chart that shows the thermal stability test results for the PDC of Working Examples 1-5 of the invention and Comparative Examples 1 and 2.

FIG. 19 is a bar chart that shows the wear resistance test results for the PDCs of working examples 1-5 of the invention and comparative examples 1 and 2. FIG. 20 is a bar chart that shows the thermal stability test results for the PDCs of working examples 1-5 of the invention and comparative examples 1 and 2. Four different Barre granite workpieces were used in the wear resistance and thermal stability tests shown in FIGS. 19 and 20. The particular workpiece used on each specific sample is indicated on the bar charts of FIGS. 19 and 20 as workpieces 1-4, respectively.

As shown in FIGS. 19 and 20, the PDCs of Working Examples 1-5 exhibit a thermal stability comparable if not better than the thermal stability of the leached PDCs of Comparative Example 2. Furthermore, the wear resistance of most of the PDCs of Working Examples 1-5 was superior to that of the PDCs of Comparative Examples 1 and 2.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a substrate; and a polycrystalline diamond table including an upper surface spaced from a back surface that is bonded to the substrate, the polycrystalline diamond table including a plurality of bonded-together diamond grains defining a plurality of interstitial regions, the polycrystalline diamond table further including:

a thermally-stable first region extending inwardly from the upper surface and spaced from the substrate by a standoff, the thermally-stable first region including aluminum carbide disposed in at least a portion of the plurality of interstitial regions thereof, the aluminum carbide occupying substantially all of the plurality of interstitial regions of the thermally-stable first region; and a second region extending inwardly from the back surface and about which the thermally-stable first region extends, the second region including a metallic constituent disposed in at least a portion of the plurality of interstitial regions thereof, the second region exhibiting a coercivity of about 115 Oe to about 250 Oe and a specific magnetic saturation of greater than 0 $G \cdot cm^3/g$ to about 15 $G \cdot cm^3/g$.

2. The polycrystalline diamond compact of claim 1 wherein at least a portion of the plurality of bonded-together diamond grains exhibit diamond-to-diamond bonding therebetween.

3. The polycrystalline diamond compact of claim 1 wherein at least a portion of the plurality of bonded-together diamond grains are bonded together with the aluminum carbide.

4. The polycrystalline diamond compact of claim 1 wherein the metallic constituent comprises at least one member selected from the group consisting of iron, nickel, cobalt, and alloys thereof.

5. The polycrystalline diamond compact of claim 1 wherein the metallic constituent comprises a metallic catalyst and the bonded-together diamond grains in the second region exhibit relatively more diamond-to-diamond bonding therebetween than the bonded-together diamond grains in the thermally-stable first region.

6. The polycrystalline diamond compact of claim 1 wherein the substrate comprises a cemented carbide substrate.

7. The polycrystalline diamond compact of claim 1 wherein the substrate comprises an aluminum-based substrate bonded to the polycrystalline diamond table and a cemented carbide substrate bonded to the aluminum-based substrate.

8. The polycrystalline diamond compact of claim 1 wherein the thermally-stable first region extends from the upper surface to an intermediate depth of about 0.20 mm to about 1.5 mm.

9. The polycrystalline diamond compact of claim 8 wherein the intermediate depth is about 0.65 mm to about 0.90 mm.

10. The polycrystalline diamond compact of claim 1 wherein the polycrystalline diamond table is integrally formed with the substrate.

11. The polycrystalline diamond compact of claim 1 wherein the polycrystalline diamond table comprises a presintered polycrystalline diamond table.

12. The polycrystalline diamond compact of claim 1 wherein the polycrystalline diamond table comprises a residual amount of metallic catalyst.

13. The polycrystalline diamond compact of claim 12 wherein the metallic catalyst was used to initially sinter the polycrystalline diamond table.

14. The polycrystalline diamond compact of claim 1 wherein the thermally-stable first region exhibits a generally annular geometry.

15. The polycrystalline diamond compact of claim 1 wherein the coercivity is about 115 Oe to about 175 Oe and the specific magnetic saturation is about 5 $G\cdot cm^3/g$ to about 15 $G\cdot cm^3/g$.

16. The polycrystalline diamond compact of claim 1 wherein the coercivity is about 155 Oe to about 175 Oe and the specific magnetic saturation is about 10 $G\cdot cm^3/g$ to about 15 $G\cdot cm^3/g$.

17. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table including an upper surface spaced from a back surface that is bonded to the substrate, the polycrystalline diamond table including a plurality of bonded-together diamond grains defining a plurality of interstitial regions, the polycrystalline diamond table further including:

a thermally-stable first region extending inwardly from the upper surface and spaced from the substrate by a standoff, the thermally-stable first region including aluminum carbide disposed in at least a portion of the plurality of interstitial regions thereof, the aluminum carbide occupying substantially all of the plurality of interstitial regions of the thermally-stable first region; and a second region extending inwardly from the back surface and about which the thermally-stable first region extends, the second region including a metallic constituent disposed in at least a portion of the plurality of interstitial regions thereof, the second region exhibiting a coercivity of about 115 Oe to about 250 Oe and a specific magnetic saturation of greater than 0 $G\cdot cm^3/g$ to about 15 $G\cdot cm^3/g$.

18. The rotary drill bit of claim 17 wherein the thermally-stable first region exhibits a generally annular geometry.

19. The rotary drill bit of claim 17 wherein the coercivity is about 115 Oe to about 175 Oe and the specific magnetic saturation is about 5 $G\cdot cm^3/g$ to about 15 $G\cdot cm^3/g$.

20. The rotary drill bit of claim 17 wherein the coercivity is about 155 Oe to about 175 Oe and the specific magnetic saturation is about 10 $G\cdot cm^3/g$ to about 15 $G\cdot cm^3/g$.

21. A polycrystalline diamond compact, comprising:

a substrate; and a polycrystalline diamond table including an upper surface spaced from a back surface that is bonded to the substrate, the polycrystalline diamond table including a plurality of bonded-together diamond grains defining a plurality of interstitial regions and exhibiting diamond-to-diamond bonding therebetween, the polycrystalline diamond table further including:

a thermally-stable first region extending inwardly from the upper surface and spaced from the substrate by a standoff, the thermally-stable first region including aluminum carbide disposed in at least a portion of the plurality of interstitial regions thereof, the aluminum carbide occupying substantially all of the plurality of interstitial regions of the thermally-stable first region, the thermally-stable first region further including a residual amount of metallic catalyst present in an amount of about 0.8 weight % to about 1.5 weight %; and a second region extending inwardly from the back surface and about which the thermally-stable first region extends, the second region including a metallic constituent disposed in at least a portion of the plurality of interstitial regions thereof, the second region exhibiting a coercivity of about 115 Oe to about 250 Oe and a specific magnetic saturation of greater than 0 $G\cdot cm^3/g$ to about 15 $G\cdot cm^3/g$.

22. The polycrystalline diamond compact of claim 21 wherein the thermally-stable first region exhibits a generally annular geometry.

23. The polycrystalline diamond compact of claim 21 wherein the coercivity is about 115 Oe to about 175 Oe and the specific magnetic saturation is about 5 $G\cdot cm^3/g$ to about 15 $G\cdot cm^3/g$.

24. The polycrystalline diamond compact of claim 21 wherein the coercivity is about 155 Oe to about 175 Oe and the specific magnetic saturation is about 10 $G\cdot cm^3/g$ to about 15 $G\cdot cm^3/g$.

25. The polycrystalline diamond compact of claim 21 wherein the residual amount of metallic catalyst is about 0.86 weight % to about 1.47 weight %.

26. A polycrystalline diamond compact, comprising:

a substrate; and a polycrystalline diamond table including an upper surface spaced from a back surface that is bonded to the substrate, the polycrystalline diamond table including a plurality of bonded-together diamond grains defining a plurality of interstitial regions, the polycrystalline diamond table further including:

a thermally-stable first region extending inwardly from the upper surface and spaced from the substrate by a standoff, the thermally-stable first region exhibiting a generally annular geometry, the thermally-stable first region including aluminum carbide disposed in at least a portion of the plurality of interstitial regions thereof; and a second region extending inwardly from the back surface and about which the thermally-stable first region extends, the second region including a metallic constituent disposed in at least a portion of the plurality of interstitial regions thereof, the second region exhibiting a coercivity of about 115 Oe to about 250 Oe and a specific magnetic saturation of greater than 0 $G \cdot cm^3/g$ to about 15 $G \cdot cm^3/g$.

27. The polycrystalline diamond compact of claim 26 wherein the metallic constituent comprises at least one member selected from the group consisting of iron, nickel, cobalt, and alloys thereof.

28. The polycrystalline diamond compact of claim 26 wherein the thermally-stable first region extends from the upper surface to an intermediate depth of about 0.20 mm to about 1.5 mm.

29. The polycrystalline diamond compact of claim 28 wherein the intermediate depth is about 0.65 mm to about 0.90 mm.

30. The polycrystalline diamond compact of claim 26 wherein the polycrystalline diamond table is integrally formed with the substrate.

31. The polycrystalline diamond compact of claim 26 wherein the polycrystalline diamond table comprises a pre-sintered polycrystalline diamond table.

32. The polycrystalline diamond compact of claim 26 wherein the polycrystalline diamond table comprises a residual amount of metallic catalyst.

33. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table including an upper surface spaced from a back surface that is bonded to the substrate, the polycrystalline diamond table including a plurality of bonded-together diamond grains defining a plurality of interstitial regions, the polycrystalline diamond table further including:

a thermally-stable first region extending inwardly from the upper surface and spaced from the substrate by a standoff, the thermally-stable first region exhibiting a generally annular geometry, the thermally-stable first region including aluminum carbide disposed in at least a portion of the plurality of interstitial regions thereof; and a second region extending inwardly from the back surface and about which the thermally-stable first region extends, the second region including a metallic constituent disposed in at least a portion of the plurality of interstitial regions thereof, the second region exhibiting a coercivity of about 115 Oe to about 250 Oe and a specific magnetic saturation of greater than 0 $G \cdot cm^3/g$ to about 15 $G \cdot cm^3/g$.

34. The rotary drill bit of claim 33 wherein the metallic constituent comprises at least one member selected from the group consisting of iron, nickel, cobalt, and alloys thereof.

35. The rotary drill bit of claim 33 wherein the thermally-stable first region extends from the upper surface to an intermediate depth of about 0.20 mm to about 1.5 mm.

36. The rotary drill bit of claim 35 wherein the intermediate depth is about 0.65 mm to about 0.90 mm.

37. The rotary drill bit of claim 33 wherein the polycrystalline diamond table is integrally formed with the substrate.

38. The rotary drill bit of claim 33 wherein the polycrystalline diamond table comprises a pre-sintered polycrystalline diamond table.

39. The rotary drill bit of claim 33 wherein the polycrystalline diamond table comprises a residual amount of metallic catalyst.

* * * * *